US009156176B2

(12) United States Patent
Kawaguchi et al.

(10) Patent No.: US 9,156,176 B2
(45) Date of Patent: Oct. 13, 2015

(54) CUTTING APPARATUS AND COMPUTER READABLE STORAGE MEDIUM

(75) Inventors: Yasuhiko Kawaguchi, Nagoya (JP); Yoshinori Nakamura, Toyohashi (JP); Masahiko Nagai, Nagoya (JP); Tomoyasu Niizeki, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 444 days.

(21) Appl. No.: 13/542,188

(22) Filed: Jul. 5, 2012

(65) Prior Publication Data

US 2013/0008292 A1 Jan. 10, 2013

(30) Foreign Application Priority Data

Jul. 5, 2011 (JP) ..... 2011-149128

(51) Int. Cl.
*B26D 5/00* (2006.01)
*B26F 1/38* (2006.01)

(52) U.S. Cl.
CPC ..... *B26D 5/005* (2013.01); *B26F 1/3813* (2013.01); *Y10T 83/162* (2015.04); *Y10T 83/173* (2015.04)

(58) Field of Classification Search
CPC .... B26D 5/005; Y10T 83/162; Y10T 83/173; B26F 1/3813
USPC ..... 83/32, 76.6; 700/134
See application file for complete search history.

(56) References Cited

U.S. PATENT DOCUMENTS

| | | | | |
|---|---|---|---|---|
| 3,816,924 | A * | 6/1974 | Cutri | 33/17 R |
| 6,502,489 | B2 * | 1/2003 | Gerent et al. | 83/49 |
| 6,810,779 | B2 * | 11/2004 | Feldman et al. | 83/32 |
| 2005/0186010 | A1 | 8/2005 | Shibata et al. | |
| 2007/0240548 | A1 * | 10/2007 | Pape | 83/76.1 |

FOREIGN PATENT DOCUMENTS

| | | | |
|---|---|---|---|
| JP | S63-131171 | A | 6/1988 |
| JP | 01-127295 | A | 5/1989 |
| JP | 10-280220 | A | 10/1998 |
| JP | 2000-225747 | A | 8/2000 |
| JP | 2001-071049 | A | 3/2001 |
| JP | 2005-205541 | A | 8/2005 |
| JP | 2005-279957 | A | 10/2005 |
| JP | 2006-166878 | A | 6/2006 |

* cited by examiner

*Primary Examiner* — Stephen Choi
(74) *Attorney, Agent, or Firm* — Fox Rothschild LLP

(57) ABSTRACT

A cutting apparatus includes a cutter, a controller and a memory configured to store instructions. The instructions instruct the controller to execute steps including arranging patterns including peripheral lines including sequential line segments. The pattern arrangement includes arranging the patterns so that the line segments of adjacent patterns overlap each other. The instructions further include identifying the overlapping line segments, generating data representing a line including the identified overlapping line segments, designating the patterns including the overlapping line segments as a pattern group and extracting parallel line segments from the line segments forming the pattern group, grouping the extracted parallel line segments into line segments parallel to each other and denoting an identical cutting direction, determining a cutting order of the line segments composing the pattern group of the patterns including the overlapping line segments and generating a signal based on the generated data and the determined cutting order.

18 Claims, 15 Drawing Sheets

| NUMBER OF PATTERNS | |
|---|---|
| PATTERN A | MASK INFORMATION |
| | FIRST COORDINATE DATA<br>SECOND COORDINATE DATA<br>THIRD COORDINATE DATA<br>FOURTH COORDINATE DATA<br>FIFTH COORDINATE DATA |
| DELIMITER DATA | |
| PATTERN B | MASK INFORMATION |
| | FIRST COORDINATE DATA<br>SECOND COORDINATE DATA<br>THIRD COORDINATE DATA<br>FOURTH COORDINATE DATA<br>FIFTH COORDINATE DATA |
| DELIMITER DATA | |
| ⋮ | ⋮ |
| PATTERN H | MASK INFORMATION |
| | FIRST COORDINATE DATA<br>SECOND COORDINATE DATA<br>THIRD COORDINATE DATA<br>FOURTH COORDINATE DATA<br>FIFTH COORDINATE DATA |
| DELIMITER DATA | |

FIG.10

| MASK INFORMATION | |
|---|---|
| OUTLINE<br>(CUTTING NO. 1) | FIRST COORDINATE DATA<br>SECOND COORDINATE DATA<br>THIRD COORDINATE DATA<br>⋮<br>FOURTEENTH COORDINATE DATA |
| DELIMITER DATA | |
| INCLINATION DIRECTION LINE SEGMENT<br>(CUTTING NO. 2) | FIRST COORDINATE DATA<br>SECOND COORDINATE DATA |
| DELIMITER DATA | |
| ⋮ | |
| INCLINATION DIRECTION LINE SEGMENT<br>(CUTTING NO. 4) | FIRST COORDINATE DATA<br>SECOND COORDINATE DATA |
| DELIMITER DATA | |
| LONGITUDINAL LINE SEGMENT<br>(CUTTING NO. 5) | FIRST COORDINATE DATA<br>SECOND COORDINATE DATA |
| DELIMITER DATA | |
| ⋮ | |
| LATERAL LINE SEGMENT<br>(CUTTING NO. 7) | FIRST COORDINATE DATA<br>SECOND COORDINATE DATA |
| DELIMITER DATA | |
| LATERAL LINE SEGMENT<br>(CUTTING NO. 8) | FIRST COORDINATE DATA<br>SECOND COORDINATE DATA |
| DELIMITER DATA | |

FIG. 12

CUTTING APPARATUS AND COMPUTER READABLE STORAGE MEDIUM

CROSS-REFERENCE TO RELATED APPLICATION

This application claims priority from Japanese Patent Application No. 2011-149128 filed on Jul. 5, 2011, which is incorporated herein by reference.

BACKGROUND

1. Field of the Invention

This application relates to a cutting apparatus and a computer readable storage media medium storing computer readable instruction.

2. Related Art

Conventionally, a cutting plotter is known. The cutting plotter can cut a pattern from a sheet such as for a paper, automatically. The sheets are attached to a base material. The base material, for example, comprises an adhesion area on a surface of the base material. The cutting plotter can also comprise a carriage. The carriage comprises, for example, a mechanism for moving a cutter of the cutting plotter along a certain direction. By moving the cutter along the certain direction by the mechanism, the cutter can move from a first position where the cutter and the sheets is closed to and contact each other to a second position where the cutter is moved away from the sheets. A driving roller and a pinch roller as a drive mechanism are set at both edges of the base material of the cutting plotter, and the driving roller and the base material can be moved toward a first direction by the driving roller and the pinch roller. And the carriage is also moved by mechanism for moving the cutter toward a second direction. The second direction is defined as across the first direction, for example, the second direction is vertical direction from the first direction. As a result of the above-mentioned processes, the cutting plotter can cut the pattern from the sheet by the cutter.

SUMMARY

When the cutting plotter cuts a plurality of patterns from the sheet, whenever the cutting plotter finishes cutting a certain pattern, it is necessary for the cutting plotter to control the cutter to move away from the sheet, and move to a next start cutting position for cutting a next pattern. That is, adding to the process of cutting the pattern, the cutting plotter also has to control the cutter to move the next starting position for cutting the next pattern, in order to cut the plurality of patterns. Therefore, the cutting plotter has to execute a process of the carriage for just moving the cutter and moving the base material, and the executed process does not include cutting the pattern. It spends a lot of time to finish cutting all of the plurality of patterns from the sheet.

Various exemplary embodiments of the general principles herein provide a cutting apparatus which may comprise a cutter and a controller. The cutting apparatus may also comprise a memory configured to store computer readable instructions therein, wherein the instructions instruct the controller to execute steps comprising arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other, identifying the overlapping line segments of the peripheral lines of the patterns, generating data representing a line including the identified overlapping line segments, designating the plurality of patterns including the overlapping line segments as a pattern group and extracting parallel line segments from the line segments forming the pattern group, grouping the extracted parallel line segments into line segments which are parallel to each other and denote an identical cutting direction, determining a cutting order of the line segments composing the pattern group including the overlapping line segments, the cutting order being usable to sequentially cut the line segments for every pattern group, and generating a signal based on the generated data and the determined cutting order, wherein the cutter is configured to cut an object based on the signal.

Exemplary embodiments herein provide an apparatus which comprises a controller. The apparatus may also comprise a memory configured to store computer readable instructions therein, wherein the computer readable instructions instruct the controller to execute steps comprising arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other, identifying the overlapping line segments of the peripheral lines of the patterns, generating data representing a line including the identified overlapping line segments, designating the plurality of patterns including the overlapping line segments as a pattern group and extracting parallel line segments from the line segments forming the pattern group, grouping the extracted parallel line segments into line segments which are parallel to each other and denote an identical cutting direction, determining a cutting order of the line segments composing the pattern group including the overlapping line segments, the cutting order being usable to sequentially cut the line segments for every pattern group, and generating a signal based on the generated data and the determined cutting order, wherein a cutter is configured to cut an object based on the signal.

Exemplary embodiments also provide a non-transitory computer readable storage medium storing computer readable instructions that, when executed, instruct an apparatus to execute steps comprising arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other, identifying the overlapping line segments of the peripheral lines of the patterns, generating data representing a line including the identified overlapping line segments, designating the plurality of patterns including the overlapping line segments as a pattern group and extracting parallel line segments from the line segments forming the pattern group, grouping the extracted parallel line segments into line segments which are parallel to each other and denote an identical cutting direction, determining a cutting order of the line segments composing the pattern group including the overlapping line segments, the cutting order being usable to sequentially cut the line segments for every pattern group, and generating a signal based on the generated data and the determined cutting order, wherein the cutter is configured to cut an object based on the signal.

BRIEF DESCRIPTION OF THE DRAWINGS

FIG. 10 shows the structure of existing full data including cutting data for a plurality of patterns;

FIG. 12 shows new generated full data corresponding to the cutting line as shown in FIG. 11E;

DETAILED DESCRIPTION

First Example

A first example will be described with reference to FIGS. 1 to 13.

Figure 1:
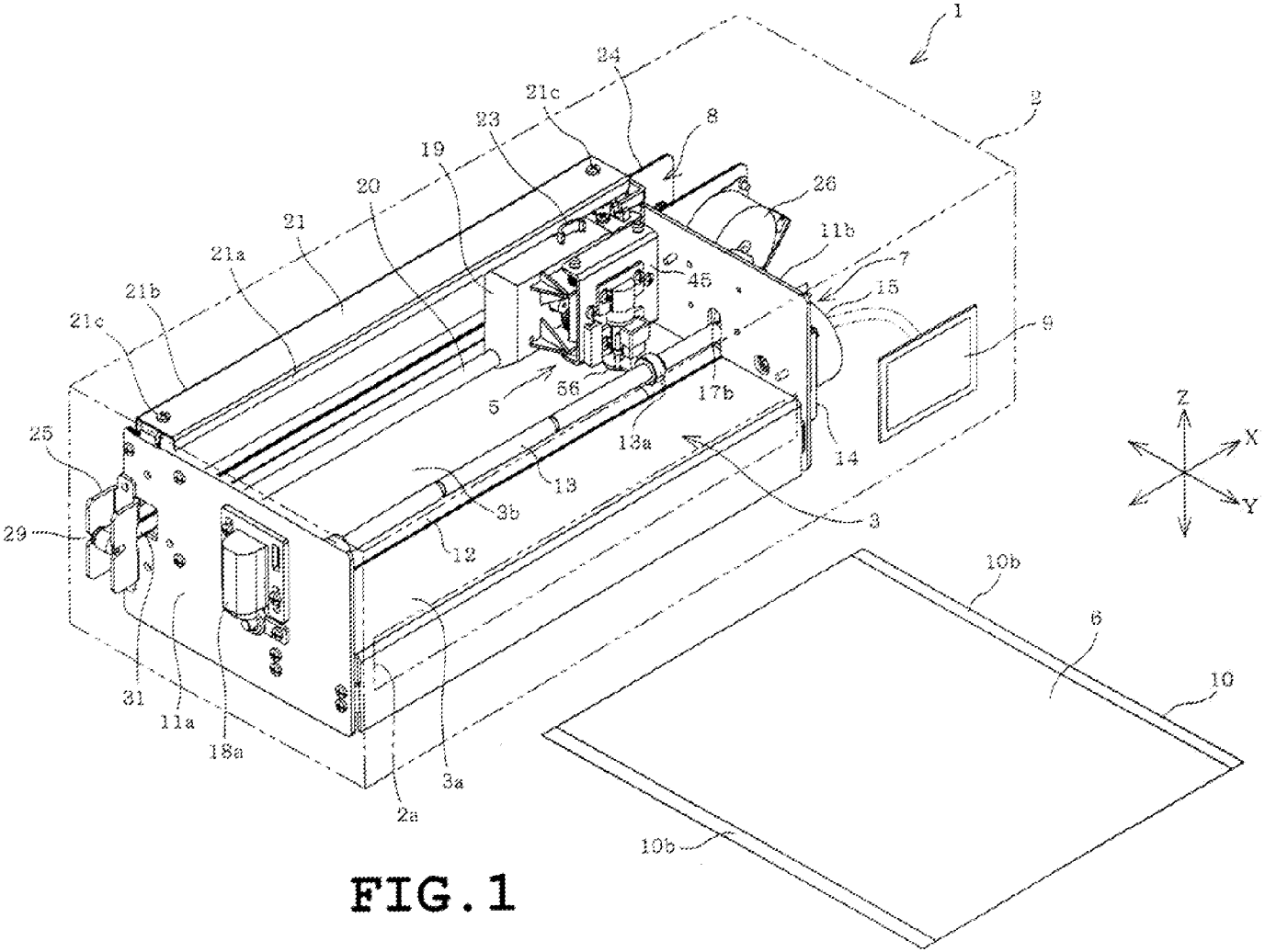
FIG. 1 is a perspective view of the cutting apparatus according to a first example, showing an inner structure thereof.

Referring to FIG. 1, a cutting apparatus 1 of the first example includes a body cover 2 as a housing, a platen 3 housed in the body cover 2 and a cutter holder 5 also housed in the body cover 2. The cutting apparatus 1 also includes a first moving unit 7 and a second moving unit 8 both for moving a cutter 4 (see FIG. 4) held by the cutter holder 5. and an object 6 to be cut, relative to each other. The body cover 2 is formed into the shape of a horizontally long rectangular box. The body cover 2 has a front formed with a horizontally long opening 2*a* which is provided for setting a holding sheet 10 holding the object 6. In the following description, a direction in which the object 6 is moved by the first moving unit 7 will be referred to as "front-rear direction." More specifically, the opening 2*a* side of the cutting apparatus 1 will be referred to as "front" and the opposite side will be referred to as "rear." The front-rear direction will be referred to as "Y direction" and the direction perpendicular to the Y direction will be referred to as "X direction."

On a right part of the body cover 2 is mounted a liquid crystal display (LCD) 9 which serves as a display unit displaying messages and the like necessary for the user. A plurality of operation switches (see VARIOUS OPERATION SWITCHES 65 in FIG. 8) is also provided on the right part of the body cover 2. The platen 3 includes a pair of front and rear plate members 3*a* and 3*b* and has an upper surface which is configured into an X-Y plane serving as a horizontal plane. The platen 3 is set so that the holding sheet 10 holding the object 6 is placed thereon. The holding sheet 10 is received by the platen 3 when the object 6 is cut. The holding sheet 10 has an upper surface with an adhesive layer 10*a* (see FIG. 7) formed by applying an adhesive agent to a part thereof except for right and left edges 10*b*. The user affixes the object 6 to the adhesive layer 10*a*, whereby the object is held by the holding sheet 10.

Figure 2:
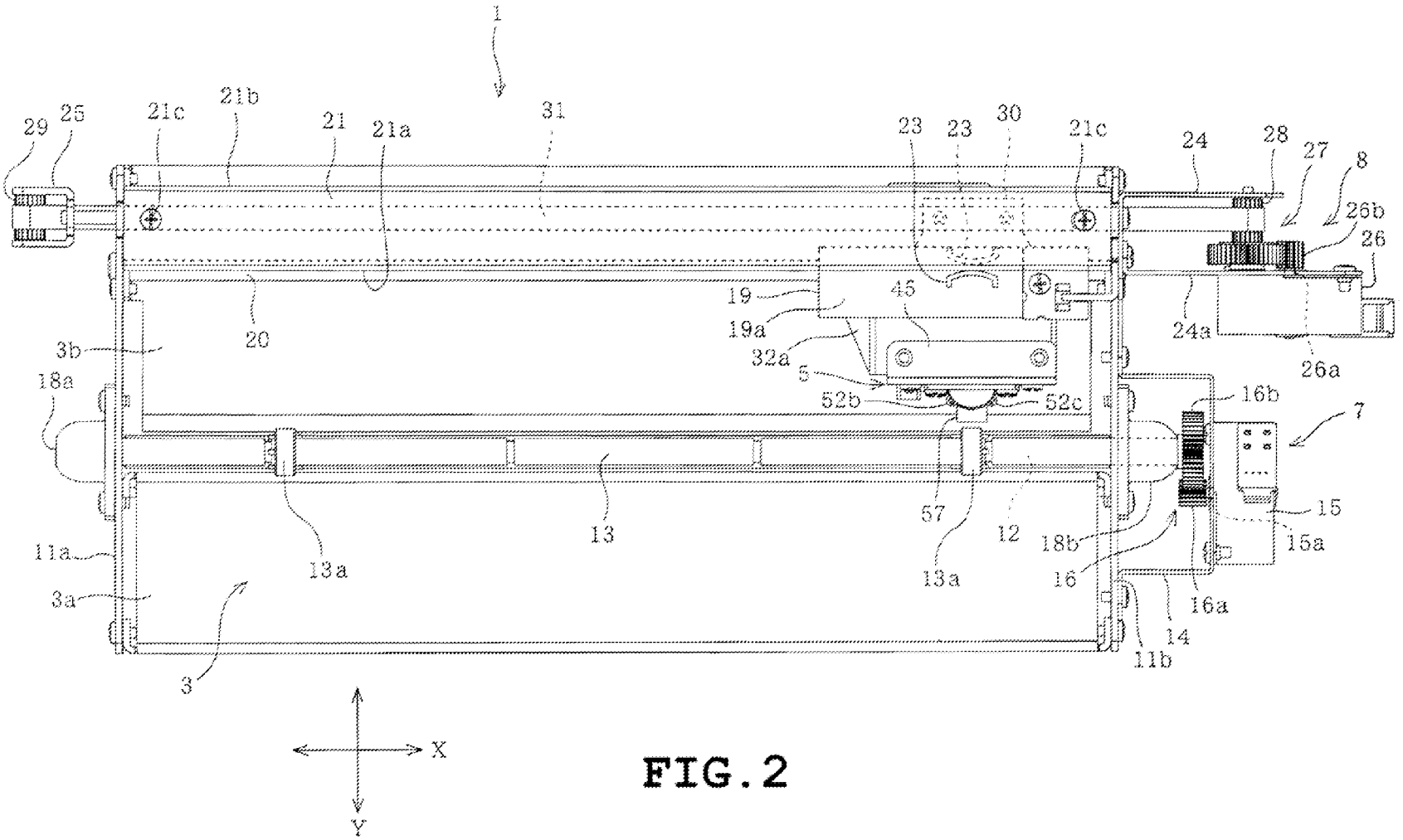
FIG. 2 is a plan view of the cutting apparatus.

The first moving unit 7 moves the holding sheet 10 on the upper surface side of the platen 3 in the Y direction (a first direction). More specifically, a driving roller 12 and a pinch roller 13 are mounted on right and left sidewalls 11*b* and 11*a* so as to be located between the plate members 3*a* and 3*b* of the platen 3. The driving roller 12 and the pinch roller 13 extend in the right-left direction and are rotatably supported on sidewalls 11*b* and 11*a*. The driving roller 12 and the pinch roller 13 are disposed so as to be parallel to the horizontal plane and so as to be vertically arranged. The driving roller 12 is located lower than the pinch roller 13. A first crank-shaped mounting frame 14 is mounted on the right sidewall 11*b* so as to be located on the right of the driving roller 12 as shown in FIG. 2. A Y-axis motor 15 is fixed to an outer surface of the mounting frame 14.

The Y-axis motor 15 comprises a stepping motor, for example. The Y-axis motor 15 has a rotating shaft 15*a* extending through the first mounting frame 14 and also has a distal end provided with a gear 16*a*. The driving roller 12 has a right end to which is secured another gear 16*b* brought into mesh engagement with the gear 16*a*. These gears 16*a* and 16*b* constitute a first reduction gear mechanism 16. The pinch roller 13 is guided by guide grooves 17*b* formed in the respective right and left sidewalls 11*b* and 11*a* so as to be movable upward and downward. Only the right guide groove 17*b* is shown in FIG. 1. Two spring accommodating members 18*a* and 18*b* are mounted on the right and left sidewalls 11*b* and 11*a* in order to cover the guide groove 17*b* from the outside, respectively. The pinch roller 13 is biased downward by compression coil springs (not shown) accommodated in the spring accommodating portions 18*a* and 18*b* respectively. The pinch roller 13 is provided with pressing portions 13*a* which are brought into contact with a left edge 10*b* and a right edge 10*c* of the holding sheet 10, thereby pressing the edges 10*b* and 10*c*, respectively. Each pressing portion 13*a* has a slightly larger outer diameter than the other portion of the pinch roller 13.

The driving roller 12 and the pinch roller 13 press the holding sheet 10 from below and from above by the urging force of the compression coil springs thereby to hold the holding sheet 10 therebetween (see FIG. 5). Upon drive of the Y-axis motor 15, normal or reverse rotation of the Y-axis motor 15 is transmitted via the first reduction gear mechanism 16 to the driving roller 12, whereby the holding sheet 10 is moved backward or forward together with the object 6. The first moving unit 7 is thus constituted by the driving roller 12, the pinch roller 13, the Y-axis motor 15, the first reduction gear mechanism 16, the compression coil springs and the like.

The second moving unit 8 is configured to move a carriage 19 supporting the cutter holder 5 in the X direction (a second direction). In more detail, a guide shaft 20 and a guide frame 21 are provided between the right and left sidewalls 11*b* and 11*a* as shown in FIGS. 1 and 2. The guide shaft 20 and the guide frame 21 are located at the rear end of the cutting apparatus 1, extending in the right-left direction. The guide shaft 20 is disposed in parallel with the driving roller 12 and the pinch roller 13. The guide shaft 20 located right above the platen 3 extends through a lower part of the carriage 19 (a through hole 22 as will be described later). The guide frame 21 has a front edge 21*a* and a rear edge 21*b* both folded downward such that the guide frame 21 has a generally C-shaped section. The front edge 21*a* is disposed in parallel with the guide shaft 20. The guide frame 21 is configured to guide an upper part (guided members 23 as will be described later) of the carriage 19 by the front edge 21*a*. The guide frame 21 is fixed to upper ends of the sidewalls 11*a* and 11*b* by screws 21*c* respectively.

A second mounting frame 24 is mounted on the right sidewall 11*b* in the rear of the cutting apparatus 1, and an auxiliary frame 25 is mounted on the left sidewall 11*a* in the rear of the cutting apparatus 1, as shown in FIG. 2. An X-axis motor 26 and a second reduction gear mechanism 27 are mounted on the second mounting frame 24. The X-axis motor 26 comprises a stepping motor, for example and is fixed to a front of a front mounting piece 24*a*. The X-axis motor 26 includes a rotating shaft 26*a* which extends through the mounting piece 24*a*. The rotating shaft 26*a* has a distal end provided with a gear 26*b* which is brought into mesh engagement with the second reduction gear mechanism 27. A pulley 28 is rotatably mounted on the second reduction gear mechanism 27, and another pulley 29 is rotatably mounted on the left auxiliary frame 25 as viewed in FIG. 2. An endless timing belt 31 connected to a rear end (a mounting portion 30 as will be described later) of the carriage 19 extends between the pulleys 28 and 29.

Upon drive of the X-axis motor 26, normal or reverse rotation of the X-axis motor 26 is transmitted via the second reduction gear mechanism 27 and the pulley 28 to the timing belt 31, whereby the carriage 19 is moved leftward or rightward together with the cutter holder 5. Thus, the carriage 19 and the cutter holder 5 are moved in the X direction perpendicular to the Y direction in which the object 6 is conveyed. The second moving unit 8 is constituted by the above-described guide shaft 20, the guide frame 21, the X-axis motor 26, the second reduction gear mechanism 27, the pulleys 28 and 29, the timing belt 31, the carriage 19 and the like.

Figure 3:
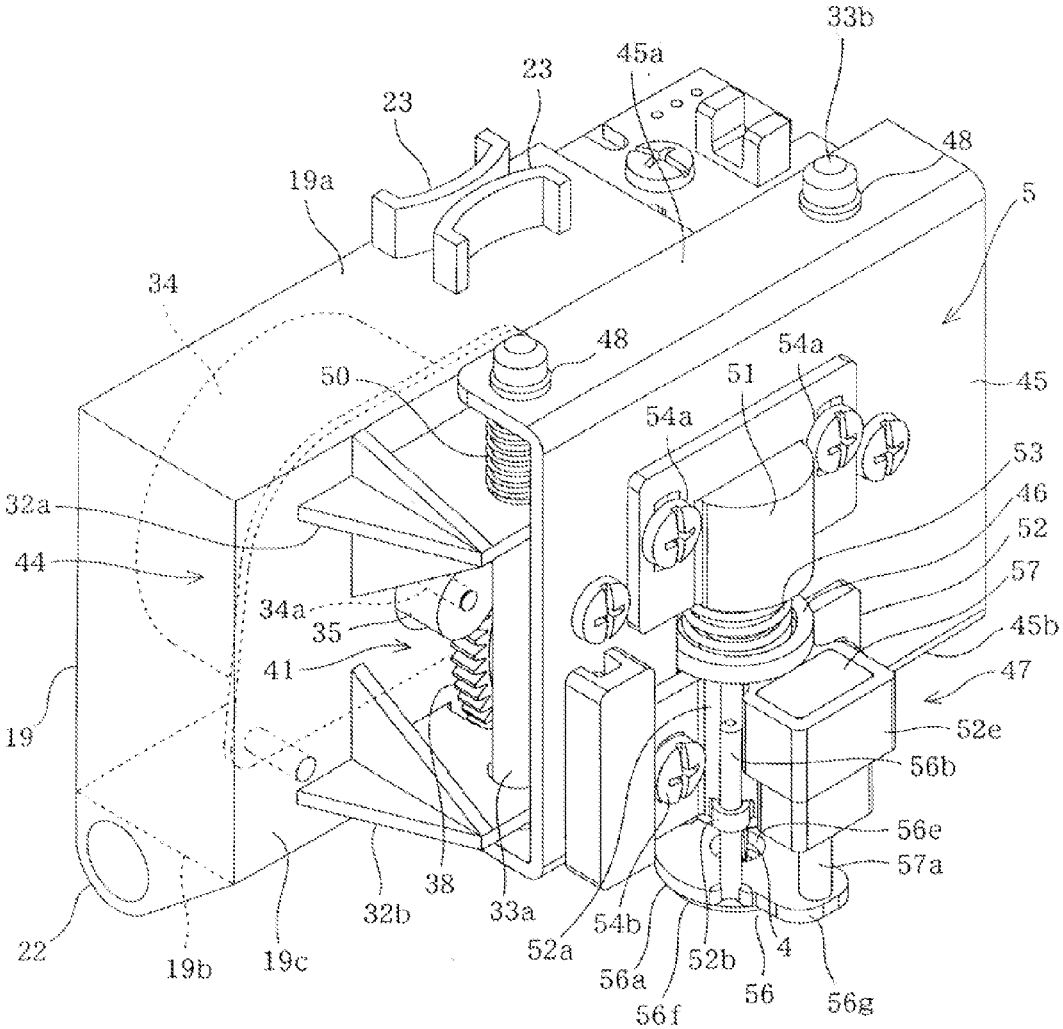
FIG. 3 is a perspective view of a cutter holder.

The cutter holder 5 is disposed on the front of the carriage 19 and supported so as to be movable in a vertical direction (a third direction) serving as a Z direction. The carriage 19 and the cutter holder 5 will be described with reference to FIGS. 3 to 7 as well as FIGS. 1 and 2. The carriage 19 is formed into the shape of a substantially rectangular box with an open rear as shown in FIGS. 2 and 3. The carriage 19 has an upper wall 19*a* with which a pair of upwardly protruding front and rear guided members 23 are integrally formed. The guided members 23 are arc-shaped ribs as viewed in a planar view. The guided members 23 are symmetrically disposed with a front edge 21*a* of the guide frame 21 being interposed therebetween. The carriage 19 has a bottom wall 19*b* further having a portion which expands downward from the underside of the bottom wall 19*b* and is formed with a pair of right and left through holes 22 through which the guide shaft 20 is inserted. An attaching portion 30 (see FIGS. 4 and 5) is mounted on the bottom wall 19*b* of the carriage 19 so as to protrude rearward. The attaching portion 30 is to be coupled with the timing belt 31. The carriage 19 is thus supported by the guide shaft 20 inserted through the holes 22 so as to be slidable in the right-left direction and further supported by the guide frame 21 held between the guided members 23 so as to be prevented from being rotated about the guide shaft 20.

Figure 4:
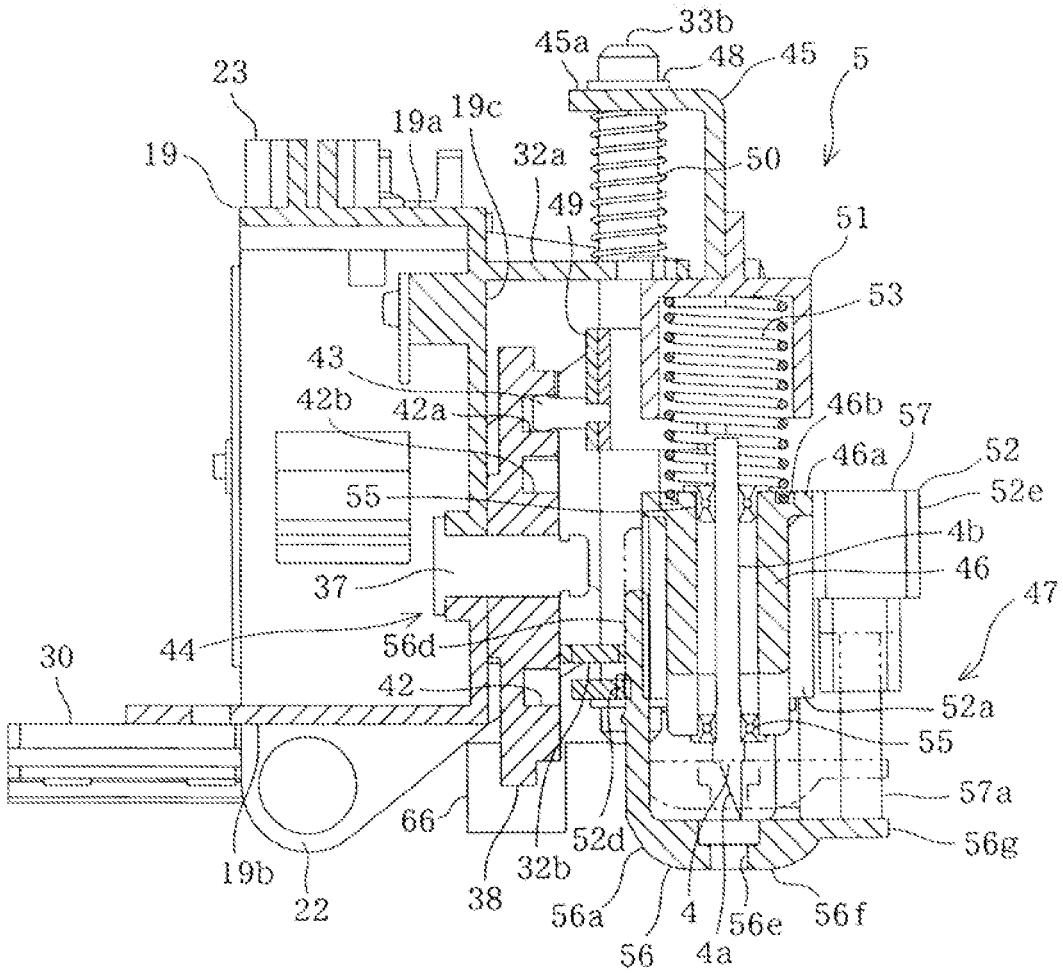
FIG. 4 is a sectional view of the cutter holder, showing the state where a cutter has been ascended.
Figure 5:
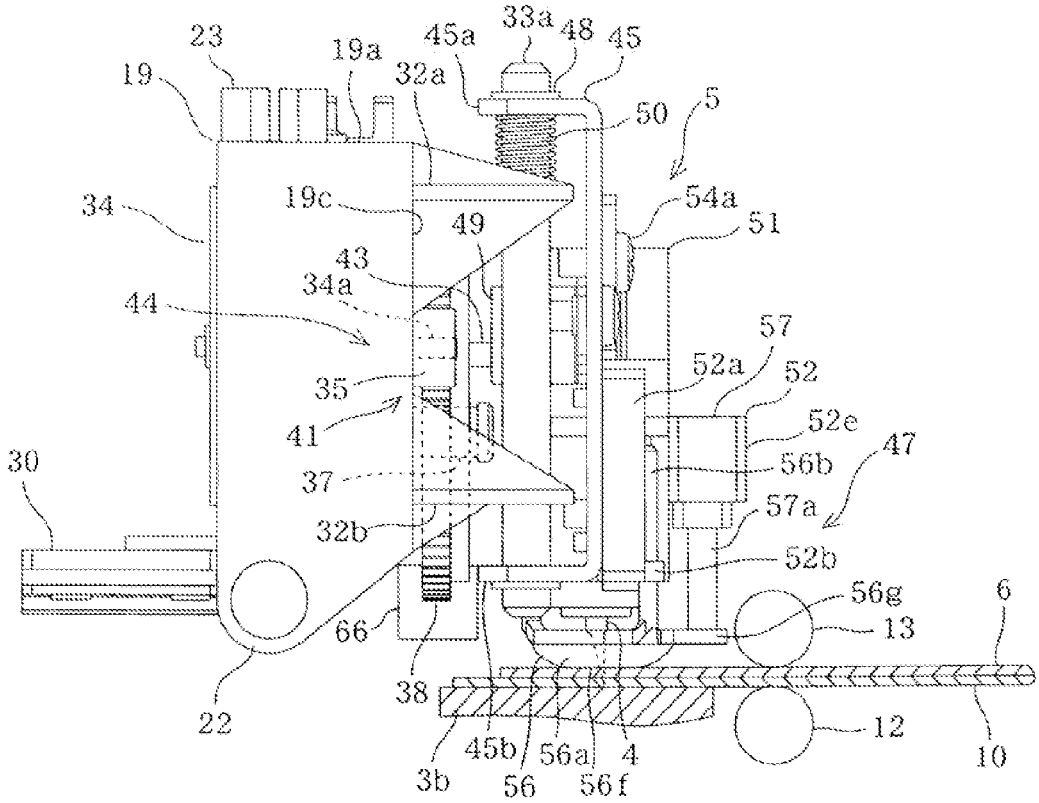
FIG. 5 is a side view of the cutter holder and the vicinity thereof, showing the case where the cutter has been descended.

The carriage 19 has a front wall 19*c* with which a pair of upper and lower support portions 32*a* and 32*b* are formed so as to extend forward as shown in FIGS. 3 to 5 and so forth. A pair of right and left support shafts 33*b* and 33*a* extending through the respective support portions 32*a* and 32*b* are mounted on the carriage 19 so as to be vertically movable. A Z-axis motor 34 comprising, for example, a stepping motor is accommodated in the carriage 19 backward thereby to be housed therein. The Z-axis motor 34 has a rotating shaft 34*a* (see FIGS. 3 and 5) which extends through the front wall 19*c* of the carriage 19. The rotating shaft 34*a* has a distal end provided with a gear 35. Furthermore, the carriage 19 is provided with a gear shaft 37 which extends through a slightly lower part of the gear 35 relative to the central part of the front wall 19*c*, as shown in FIG. 4. A gear 38 is rotatably mounted on the gear shaft 37 and adapted to be brought into mesh engagement with the gear 35 in front of the front wall 19*c*. The gear 38 is retained by a retaining ring (not shown) mounted on a front end of the gear shaft 37. The gears 35 and 38 constitute a third reduction mechanism 41 (see FIGS. 3 and 5).

Figure 6:
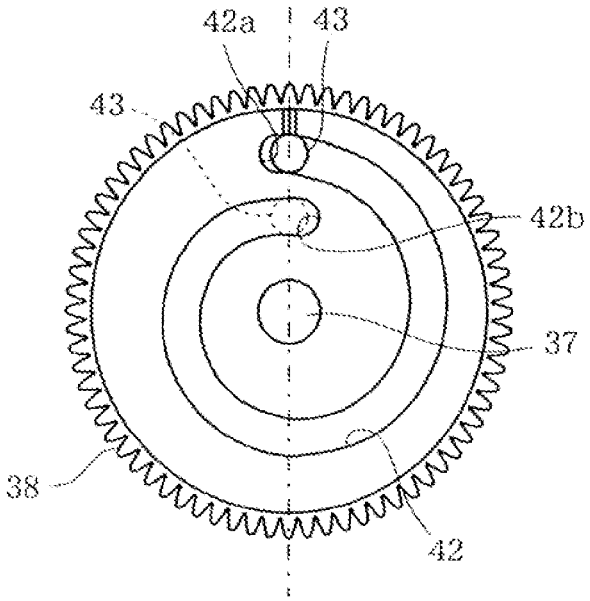
FIG. 6 is an enlarged front view of a gear.

The gear 38 is formed with a spiral groove 42 serving as a cam groove as shown in FIG. 6. The spiral groove 42 is formed into a spiral shape such that the spiral groove 42 comes closer to the center of the gear 38 as it is turned rightward from a first end 42*a* toward a second end 42*b*. An engagement pin 43 is configured to engage the spiral groove 42 (see FIG. 4) as will be described in detail later. The engagement pin 43 is vertically moved together with the cutter holder 5. Upon normal or reverse rotation of the Z-axis motor 34, the gear 38 is rotated via the gear 35. Rotation of the gear 38 vertically slides the engagement pin 43 in engagement with the spiral groove 42. With the vertical slide of the gear 38, the cutter holder 5 is moved upward or downward together with the support shafts 33*a* and 33*b*. More specifically, the cutter holder 5 assumes a raised position when the engagement pin 43 is located at the first end 42*a* of the spiral groove 42. Or the cutter holder 5 assumes a lowered position when the engagement pin 43 is located at the second end 42*b* of the spiral groove 42. The cutter holder 5 is thus moved between the raised position (see FIGS. 4 and 6) and the lowered position (see FIGS. 5 and 6). A third moving unit 44 which moves the cutter holder 5 upward and downward is constituted by the above-described third reduction mechanism 41 having the spiral groove 42, the Z-axis motor 34, the engagement pin 43, the support portions 32*a* and 32*b*, the support shafts 33*a* and 33*b*, etc.

The cutter holder 5 includes a holder body 45, a movable cylindrical portion 46 and a pressing device 47. The holder body 45 is mounted on the support shafts 33*a* and 33*b*. The movable cylindrical portion 46 has a cutter 4 (a cutting blade) and is held by the holder body 45 so as to be vertically movable. The pressing device 47 is configured to press the object 6.

More specifically, the holder body 45 has an upper end 45*a* and a lower end 45*b* both of which are folded rearward such that the holder body 45 is generally formed into a C-shape, as shown in FIGS. 3 to 5 and so forth. The upper and lower ends

45*a* and 45*b* are immovably fixed to the support shafts 33*a* and 33*b* by retaining rings 48 fixed to upper and lower ends of the support shafts 33*a* and 33*b*, respectively. The support shaft 33*b* has a middle part to which is secured a coupling member 49 provided with a rearwardly directed engagement pin 43 as shown in FIGS. 4 and 5. The holder body 45, support shafts 33*a* and 33*b*, the engagement pin 43 and the coupling member 40 are formed integrally with one another. The cutter holder 5 is vertically moved by the third moving unit 44 in conjunction with the engagement pin 43. Furthermore, compression coil springs 50 serving as biasing members are mounted about the support shafts 33*a* and 33*b* so as to be located between upper surfaces of the support portion and upper end of the holder body 45, respectively. The entire cutter holder 5 is elastically biased upward by a biasing force of the compression coil springs 50 relative to the carriage 19 side.

Mounting members 51 and 52 are fixed to the middle portion of the holder body 45 by screws 54*a* and 54*b* respectively, as shown in FIG. 3. The mounting members 51 and 52 are provided for mounting the movable cylindrical portion 46, the pressing device 47 and the like are fixed to the middle portion of the holder body 45 by screws 54*a* and 54*b* respectively. The lower mounting member 52 is provided with a cylindrical portion 52*a* (see FIG. 4) which supports the movable cylindrical portion 46 so that the movable cylindrical portion 46 is vertically movable. The movable cylindrical portion 46 has a diameter set so that the movable cylindrical portion 46 is allowed to be brought into a sliding contact with the inner peripheral surface of the cylindrical portion 52*a*. The movable cylindrical portion 46 has an upper end on which a flange 46*a* supported on an upper end of the cylindrical portion 52*a* is formed so as to expand radially outward. A spring shoe 46*b* is mounted on an upper end of the flange 46*a*. A compression coil spring 53 is interposed between the upper mounting member 51 and the spring shoe 46*b* of the movable cylindrical portion 46 as shown in FIG. 4. The compression coil spring 53 biases the movable cylindrical portion 46 (the cutter 4) to the lower object 6 side while allowing the upward movement of the movable cylindrical portion 46 against the biasing force when an upward force acts on the cutter 4.

Figure 7:
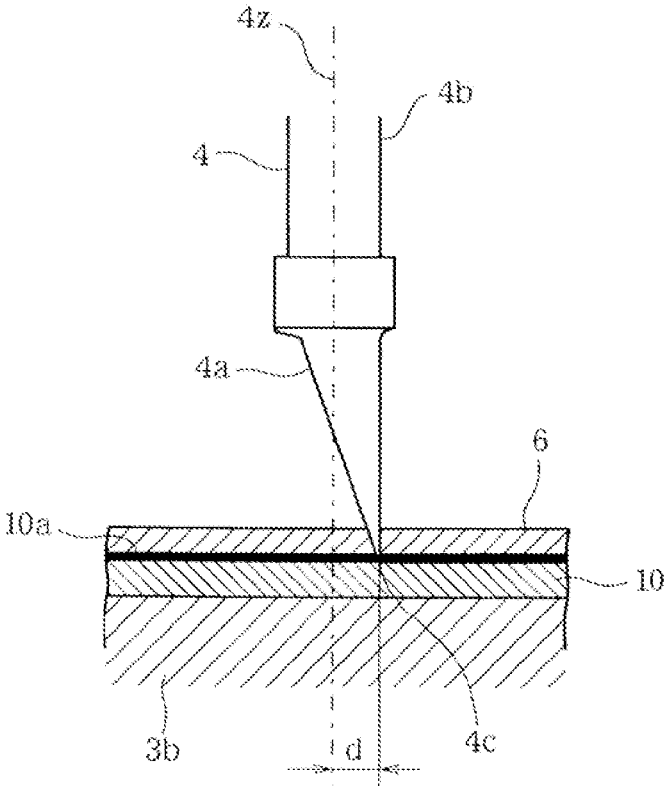
FIG. 7 is an enlarged view of the vicinity of a distal end of the cutter during the cutting.

The cutter 4 is provided in the movable cylindrical portion 46 so as to extend through the movable cylindrical portion 46. In more detail, the cutter 4 has a round bar-like cutter shaft 4*b* which is longer than the movable cylindrical portion 46 and a blade 4*a* integrally formed on a lower end of the cutter shaft 4*b*. The blade 4*a* is formed into a substantially triangular shape. The blade 4*a* has a lowermost blade edge 4*c* formed at a location offset by a distance d from a central axis 4*z* of the cutter shaft 4*b*, as shown in FIG. 7. Bearings 55 (see FIG. 4) are provided in the movable cylindrical portion 46 so as to be located at upper and lower ends respectively. The cutter 4 is held by bearings 55 so as to be rotatably movable about the central axis 4*z* (the Z axis) in the vertical direction. Thus, the blade edge 4*c* of the cutter 4 presses an X-Y plane or the surface of the object 6 from the Z direction perpendicular to the X-Y plane. Furthermore, the cutter 4 has a height that is set so that when the cutter holder 5 has been moved to the lowered position, the blade edge 4*c* passes through the object 6 on the holding sheet 10 but does not reach the upper surface of the plate member 3*b* of the platen 3, as shown in FIG. 7. On the other hand, the blade edge 4*c* of the cutter 4 is moved upward with movement of the cutter holder 5 to the raised position, thereby being spaced from the object 6 (see FIG. 4).

Three guide holes 52*b*, 52*c* and 52*d* (see FIGS. 2 to 5) are formed at regular intervals in a circumferential edge of the lower end of the cylindrical portion 52*a*. A pressing member 56 is disposed under the cylindrical portion 52*a* and has three guide bars 56*b*, 56*c* and 56*d* which are to be inserted into the guide holes 52*b* to 52*d* respectively. The pressing member 56 includes a lower part serving as a shallow bowl-shaped pressing portion body 56*a*. The aforementioned equally-spaced guide bars 56*b* to 56*d* are formed integrally on the circumferential end of the top of the pressing portion body 56*a*. The guide bars 56*b* to 56*d* are guided by the respective guide holes 52*b* to 52*d*, so that the pressing member 56 is vertically movable. The pressing portion body 56*a* has a central part formed with a through hole 56*e* which vertically extends to cause the blade 4*a* to pass therethrough. The pressing portion body 56*a* has an underside serving as a contact portion 56*f* which is brought into a surface contact with the object 6 while the blade 4*a* is located in the hole 56*e*. The contact portion 56*f* is formed into an annular horizontal flat surface and is brought into surface contact with the object 6. The contact portion 56*f* is made of a fluorine resin such as Teflon® so as to have a lower coefficient of friction, whereupon the contact portion 56*f* is rendered slippery relative to the object 6.

The pressing portion body 56*a* has a guide 56*g* which is formed integrally on the circumferential edge thereof so as to extend forward, as shown in FIGS. 3 to 5 and so forth. On the other hand, the mounting member 52 has a front mounting portion 52*e* for a solenoid 57, integrally formed therewith. The front mounting portion 52*e* is located in front of the cylindrical portion 52*a* and above the guide 56*g*. The solenoid 57 serves as an actuator for vertically moving the pressing member 56 thereby to press the object 6 and constitutes a pressing device 47 together with the pressing member 56 and a controller 61 which will be described later. The solenoid 57 is mounted on the front mounting portion 52*e* so as to be directed downward. The solenoid 57 includes a plunger 57*a* having a distal end fixed to the upper surface of the guide 56*g*. When the solenoid 57 is driven with the cutter holder 5 located at the lowered position, the pressing member 56 is moved downward together with the plunger 57*a* thereby to press the object 6 with a predetermined pressure (see FIG. 5), as will be described in detail later. In contrast, when the plunger 57*a* is located above during non-drive of the solenoid 57, the pressing member releases the object 6 from application of the pressing force. When the cutter holder 5 is moved to the raised position during non-drive of the solenoid 57 (see two-dot chain line in FIG. 4), the pressing member 56 is completely spaced from the object 6.

The holding sheet 10 has an adhesive layer 10*a* (see FIG. 7) for holding the object 6. The object 6 is immovably held on the holding sheet 10 by a resultant force of adhesion of the adhesive layer 10*a* and a pressing force of the pressing device 47. The holding sheet 10 is made of, for example, a synthetic resin and formed into a flat rectangular plate shape, as shown in FIG. 1. The holding sheet 10 has an upper side (a side opposite the cutter 4) on which the adhesive layer 10*a* is formed by applying an adhesive agent to the holding sheet 10, as shown in FIG. 7. The sheet-like object 6 such as paper, cloth, resin film or the like is removably held by the adhesive layer 10*a*. The adhesive layer 10*a* has an adhesion that is set to a small value such that the object 6 can easily be removed from the adhesive layer 10*a* without breakage thereof.

Figure 8:
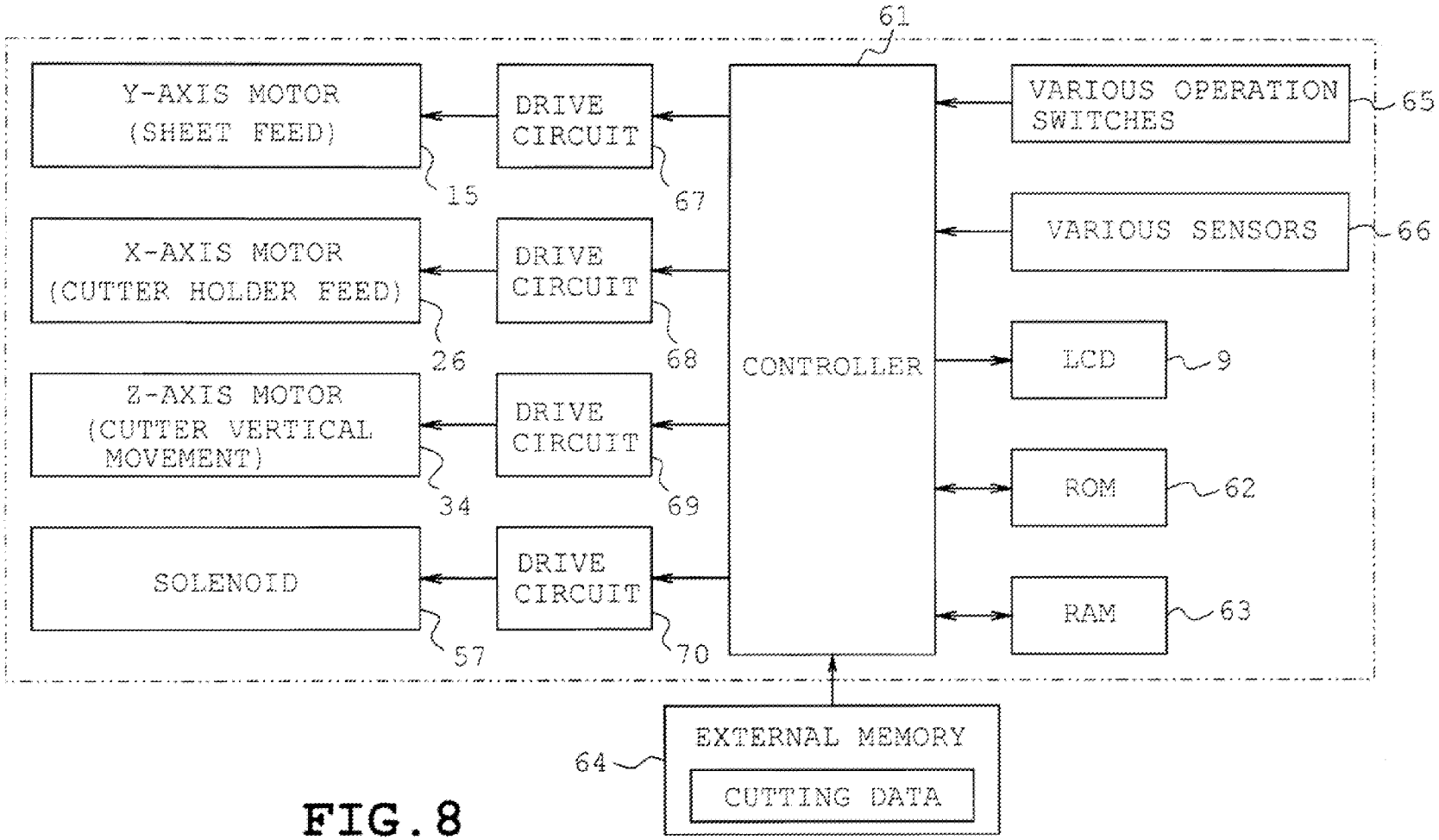
FIG. 8 is a block diagram showing an electrical arrangement of the cutting apparatus.

An electrical arrangement of the control system of the cutting apparatus 1 will now be described with reference to a block diagram of FIG. 8. A controller 61 controlling the entire cutting apparatus 1 mainly comprises a computer (CPU). A ROM 62, a RAM 63 and an external memory 64 are connected to the controller 61. The ROM 62 stores a cutting control program for controlling the cutting operation, a cutting data processing program and the like. The RAM 63 temporarily stores data and programs necessary for execution of various processing manners. The external memory 64 stores a plurality of types of cutting data, full data which will be described later, area data indicative of areas where cutting is allowed, and the like.

Operation signals are supplied from the various operation switches 65 to the controller 61. The controller 61 controls a displaying operation of the LCD 9. In this case, while viewing the displayed contents of the LCD 9, the user operates the switches 65 to select and designate pattern cutting data of a desired pattern. The operation switches 65 also serve as input units for setting a high-speed cutting process by user's input operation as will be described later.

Detection signals are also supplied to the controller 61 from various sensors 66 such as a sensor for detecting the holding sheet 10 set through the opening 2*a* of the cutting apparatus 1. To the controller 61 are also connected drive circuits 67 to 70 driving the Y-axis, X-axis and Z-axis motors 15, 26 and 34 and the solenoid 57. The controller 61 controls the Y-axis, X-axis and Z-axis motors 15, 26 and 34 and the solenoid 57, based on cutting data, whereby a cutting operation is automatically executed for the object 6 on the holding sheet 10.

Figure 9A:
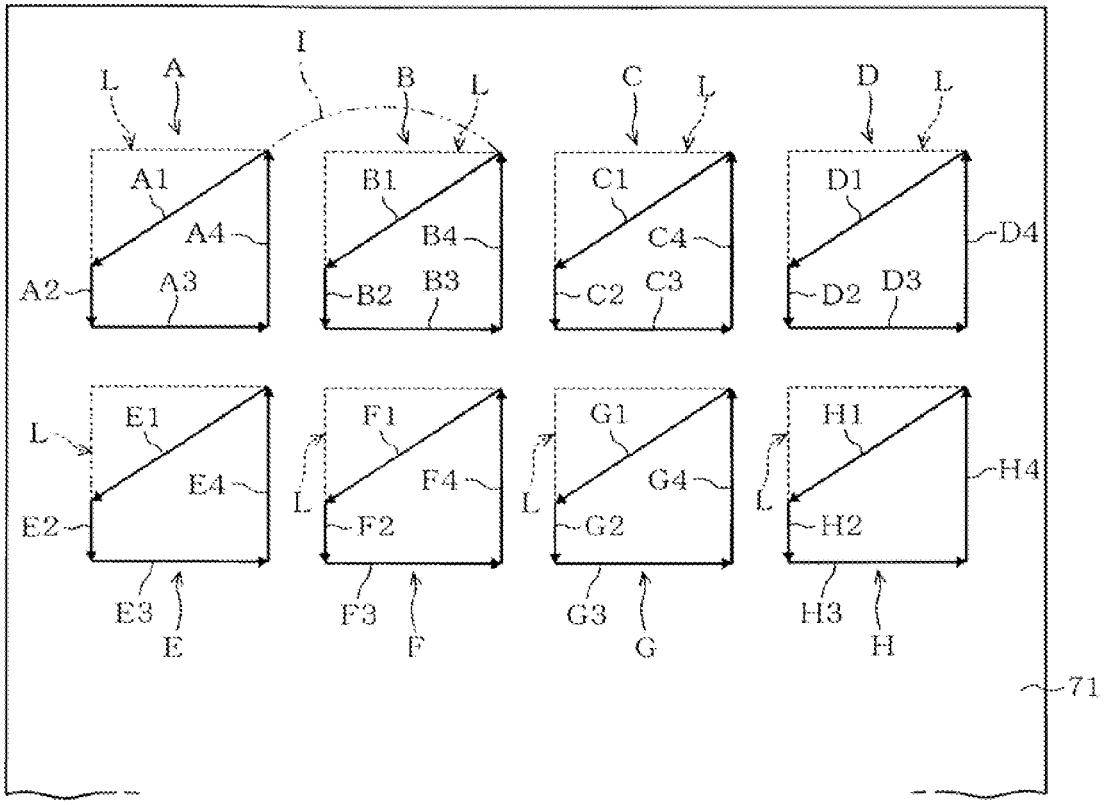
FIGS. 9A and 9B are a view explaining a plurality of patterns to be formed on the basis of an existing cutting data and an enlarged view showing one of the patterns respectively.
Figure 9B:
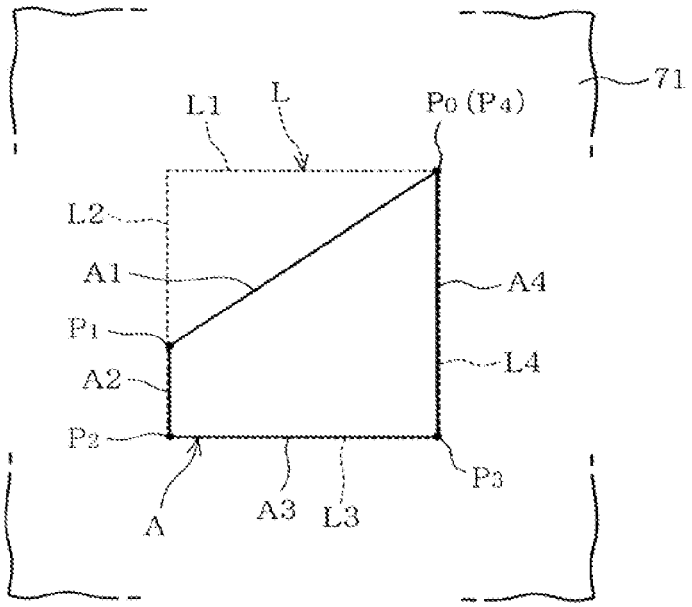

The cutting data will now be described with an example in which a plurality of, for example, eight patterns are cut from the object 6 held on the holding sheet 10. A sheet of paper is employed as the object 6 in the example. Furthermore, each pattern is trapezoidal as shown in FIG. 9B. Eight trapezoidal patterns are to be cut as shown in FIG. 9A. The eight patterns are labeled as A to H respectively for the sake of easiness in explanation. The full data in this case includes "the number of patterns" as information about the total number of patterns, cutting data of "patterns A to H" and "delimiter data". The number of patterns is 8. The cutting data of each of patterns A to H comprises X-Y coordinate data indicating apexes of cutting lines or peripheral lines composed of a plurality of line segments.

More specifically, a cutting line of pattern A includes four line segments A1 to A4 constituting a closed trapezoid in which the cutting start and end points $P_0$ and $P_4$ correspond with each other, as shown in FIG. 9B. The trapezoid includes two apexes $P_2$ and $P_3$ each having a set angle of 90° and also includes, as the cutting data, first to fifth coordinate data corresponding to cutting start point $P_0$, apexes $P_1$ to $P_3$, and cutting end point $P_4$ respectively (see FIG. 1).

The other patterns B to H are trapezoids which are the same as pattern A as shown in FIG. 9A. Cutting lines of patterns B to H also include line segments B1 to B4, C1 to C4, . . . and H1 to H4 in the same manner as pattern A respectively. Coordinate values (first to fifth coordinate value data) of patterns B to H are configured to set so that patterns A to H are formed separately from one another.

The cutting data of patterns A to H contain respective pieces of mask information as shown in FIG. 10. The mask information is data indicative of a minimum rectangular frame L encompassing a peripheral edge as an outline of each pattern A-H. For example, the rectangular frame L as shown in FIG. 9B is formed into a rectangle and contains pattern A. Of line segments L1 to L4 of the rectangular frame L, two line segments L3 and L4 correspond with line segments A3 and A4 of pattern A respectively. The other line segments L1 and L2 overlap parts of line segments A1 and A2 of pattern A respectively. Mask information of a minimum rectangular frame L encompassing the outline of each pattern is also stored regarding each of the other patterns B to H. Mask information is set according to an outline of pattern. Accordingly, the frame may not be rectangular but may have a frame-like shape allowing the frame to encompass a pattern.

When the patterns A to H are to be cut based on the full data shown in FIG. 10, the cutting is carried out sequentially from pattern A. More specifically, firstly, the cutter 4 is moved to the X-Y coordinate of the cutting start point $P_0$ of the pattern A relative to the object 6. The movement includes the movement of the holding sheet 10 (the object 6) in the Y direction by the first moving unit 7 and the movement of the cutter holder 5 in the X direction by the second moving unit 8. The cutter 4 is then relatively moved by the third moving unit 44 so that the blade edge 4*c* penetrates through the cutting start point $P_0$ of the object 6. The cutter 4 is next relatively moved toward the coordinate of the end point $P_1$ of the line segment A1 by the first and second moving units 7 and 8. As a result, the object 6 is cut along line segment A1 by the cutter 4. The end point $P_1$ of the previous line segment A1 serves as a start point $P_0$ of the next line segment A2. The cutting of line segment A2 is also carried out in the same manner as the line segment A1 continuously. Regarding each of the line segments A2 to A4, the cutter 4 is also moved in the direction as shown by arrow in FIG. 9A. Consequently, the pattern A is cut along the cutting line of "trapezoid." Patterns B to H are also cut along the cutting lines in the order of the patterns B, C, and H based on the cutting data, respectively.

Delimiter data are affixed to ends of cutting data of patterns A to H in the full data respectively. The blade edge 4*c* of the cutter 4 is spaced from the object 6 by the third moving unit 44 on the basis of the delimiter data every time when the cutting of each cutting line is completed. The cutter 4 is then relatively moved to a location corresponding to a next cutting start point. This relative movement is an empty feed without the cutting of the object 6 and a linear movement. Symbol "I" in FIG. 9A designates empty feed from the cutting line of pattern A to the cutting line of pattern B for the sake of easiness in explanation.

A time period of forward and backward feed of the holding sheet 10 without the cutting of the object 6 is thus increased with an increase in the number of patterns to be cut. The time period of forward and backward feed refers to a moving time of the holding sheet 10 by the drive roller 12 and the pinch roller 13. Furthermore, a time period of vertical movement of the cutter 4 and a time period of movement of the carriage 19 are also increased. Accordingly, a substantial time period is required for the cutting of all the patterns A to H.

Figure 11A:
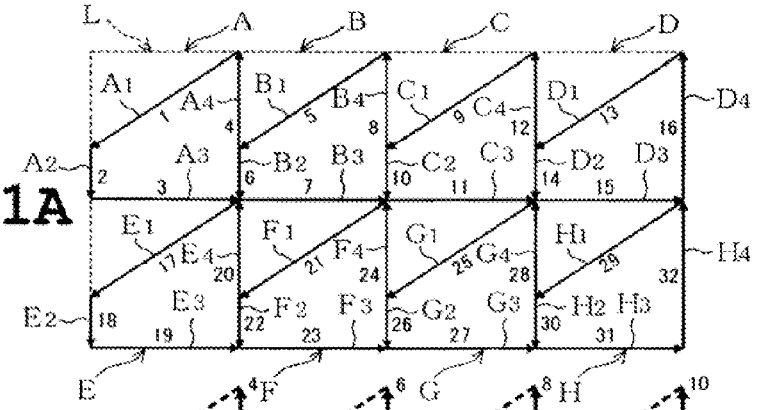
FIG. 11A is a view showing a plurality of patterns arranged so that parts of a cutting line neighbor with each other in contact with each other.

In view of the above-described problem, new cutting data capable of reducing the cutting time period is generated on the basis of the above-mentioned existing full data in the cutting apparatus 1 of the example. More specifically, the cutting apparatus 1 is provided with a software configuration (execution of a cutting data processing program) which generates cutting data about new cutting lines. For example, the new cutting lines are arranged so that patterns A to H are adjacent to one another in the X and Y directions, as shown in FIG. 11A. In this case, the patterns A to H are arranged so that at least parts of the patterns A to H are neighboring in contact with one another. Consequently, the patterns A to H are regarded as a single pattern group. Cutting data is generated on which cutting lines of an outline of the entire pattern group are continuously cut.

The external memory 64 stores region data, which is indicative of, for example, a cuttable region 71 (see FIG. 9A) set on the basis of the size of the sheet-like object 6 (or the holding sheet 10). The pattern group is arranged so as to be fitted within the cuttable region 71 on the basis of the region data and the existing full data as will be described in detail later.

Figure 13:
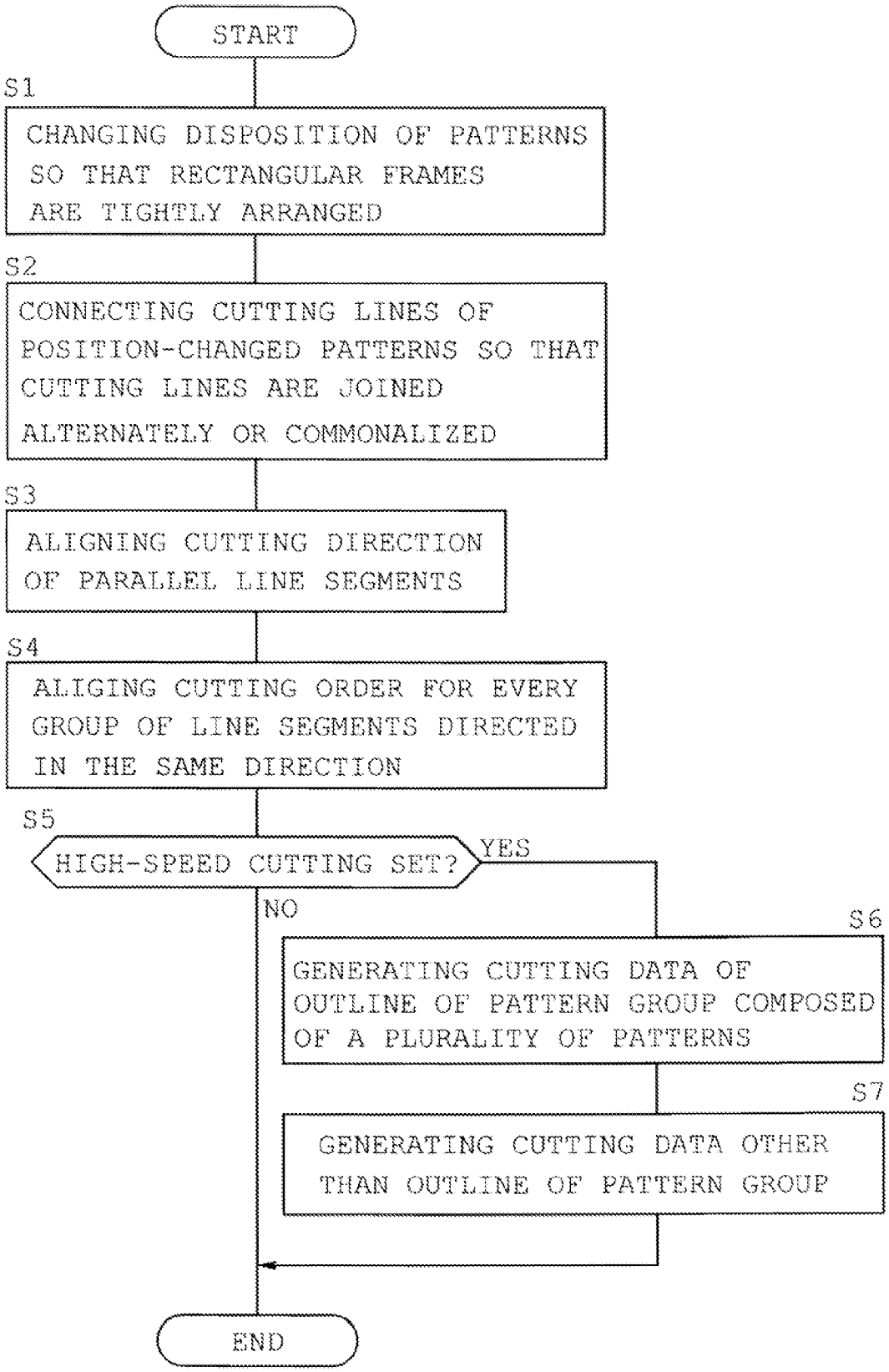
FIG. 13 is a flowchart showing the processing in the case where the new cutting data is generated.

FIGS. 11A to 11E illustrate a concrete processing procedure in the case where new cutting data of the pattern group (full data) is generated. The concrete processing procedure will now be described with reference to FIGS. 12 and 13 as well as FIGS. 1 to 11E. FIG. 12 shows full data of the pattern group and FIG. 13 is a flowchart showing the processing of a cutting data processing program executed by the controller 61.

The user firstly sets the holding sheet 10 holding the object 6 through the opening 2*a* of the cutting apparatus 1. The user further operates one or more of the operation switches 65 to instruct paper feeding. The user then selects a desired one of cutting data (the full data as shown in FIG. 10, for example) stored in the external memory 64, for example. As a result, the full data is read from the external memory 64, and the region data corresponding to the holding sheet 10 is also read to be expanded to the RAM 63. The read full data is provided for cutting the eight patterns A to H spaced from one another, as shown in FIG. 9A.

The controller 61 arranges the patterns A to H so that the respective rectangular frames L are closely arranged within the cuttable region 71, based on the mask information of the patterns A to H and the region data. As a result, the patterns A to H are changed into coordinates arranged so that at least parts of the cutting lines are neighboring in contact with one another (step S1). In more detail, X coordinates of patterns A to D and E to H are changed so that the line segments L1 and L3 (see FIG. 9B) of the rectangular frames A to D and E to H are linearly continuous in the X direction, as shown in FIG. 11A. Furthermore, Y coordinates of the patterns A and E are changed so that the line segments L2 and L4 of the rectangular frames L of the respective patterns A and E are linearly continuous. In the same manner as described above, the Y coordinates of the line segments L2 and L4 of the rectangular frames L of the patterns B and F, C and G, and D and H are changed so that the line segments L2 and L4 are linearly continuous in the Y direction. As a result, the patterns A to H are changed into coordinates such that the line segments of the neighboring patterns overlap or the line segments are arranged so as to be continuous in the X or Y direction. The rectangular frames L of the respective patterns A to H are shown only in FIG. 11A and eliminated in FIG. 11B to 11E.

The initial cutting directions and cutting orders (referred to as "cutting No.") are maintained even after reposition of patterns A to H. Arrows in FIG. 11A indicate cutting directions and numerals in FIG. 11A designate cutting Nos. The controller 61 then extracts, as an extraction unit, contact portions of the cutting lines in patterns A to H after reposition. The extraction is carried out based on data (line segment data) of coordinates of start and end points of the line segments in the patterns A to H. The controller 61 joins the post-reposition cutting lines of the patterns A to H to one another at the extracted contact portions or connects the post-reposition cutting lines so that the cutting lines are commonalized (step S2).

For example, line segments B3 to D3 of the patterns B to D are extensions of line segment A3 of pattern A in FIG. 11A in the X direction. More specifically, regarding each of the line segments A3 to D3, an end of each line segment is in contact with an end of a neighboring line segment, whereupon ends in contact with each other have respective coordinate data corresponding to each other. Accordingly, the line segments A3 to D3 are integrated to a single line segment (see line segment of cutting No. 3 in FIG. 11B). As a result, the line segments A3 to D3 of the patterns A to D are presented as single line segment data. More specifically, the line segments A3 to D3 of patterns A3 to D3 are presented as coordinate data of start and end points in cutting No. 3 line segment. In the same manner, the line 30. segments E3 to H3 of the patterns E to H as shown in FIG. 11B are integrated to a single cutting number 13 line segment.

Furthermore, the line segment E4 of pattern E and line segment F2 of pattern F are extensions of line segment A4 of pattern A in FIG. 11A in the Y direction. Furthermore, a part of the line segment A4 overlaps the line segment B2 of pattern B. The line segments A4, E4 and F2 of the respective patterns A, E and F are combined into a single line segment (see cutting No. 4 line segment in FIG. 11B). In the same manner, the line segments B4, F4, G2 and C2 of the respective patterns B, F, G and C are combined into a single line segment (see cutting No. 6 line segment in FIG. 11B). The line segments C4, G4, H2 and D2 of the respective patterns C, G, H and D are combined into a single line segment (see cutting No. 8 line segment in FIG. 11B). The line segments D4 and H4 of the respective patterns D and H are combined into a single line segment (see cutting No. 10 line segment in FIG. 11B).

Figure 11B:
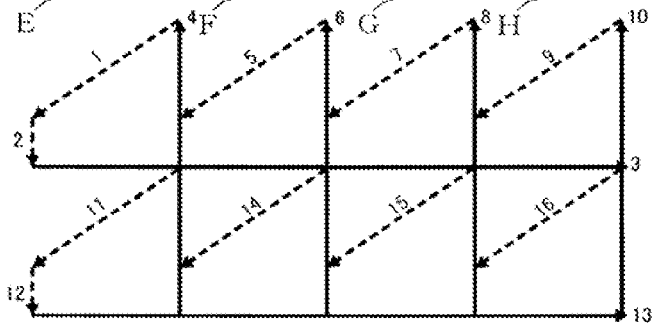
FIG. 11B shows a cutting line obtained by joining the parts of the cutting line in FIG. 11A together or by connecting the parts of the cutting line in FIG. 11A so that the parts are commonalized.

Thus, when the cutting lines of the neighboring patterns include respective line segments which are linearly continuous in the same direction or which overlap each other, these line segments are connected together into a single line segment (see line segments of cutting Nos. 3, 4, 6, 8, 10 and 13) indicated by solid lines as shown in FIG. 11B). More specifically, the controller 61 is configured as a connecting unit which connects the line segments. Eight patterns A to H are regarded as a single pattern group by the controller 61 in execution of a connecting process. As a result, the number of line segments constituting the whole pattern group is decreased by half from 32 to 16 as shown in FIG. 11B.

In the state as shown in FIG. 11B, the controller 61 extracts parallel line segments at step S3 based on line segment data in the pattern group. More specifically, the controller 61 extracts line segments of cutting Nos. 3 and 13 as a line segment parallel to the X direction and line segments of cutting Nos. 2, 4, 6, 8, 10 and 12 as a line segment parallel to the Y direction. The controller 61 extracts line segments of cutting Nos. 7, 9, 11, 14, 15 and 16 as a line segment parallel to the line segment of cutting No. 1 which extends in an oblique direction. Of these line segments, the line segments of cutting Nos. 2 and 12 and the line segments of cutting Nos. 4, 6, 8, and 10 are oppositely directed. The controller 61 then interchanges coordinate data of start and end points of respective line segment data regarding cutting Nos. 4, 6, 8 and 10. As a result, the line segments of cutting Nos. 4, 6, 8 and 10 are changed so as to have a single downward cutting direction. Thus, when the pattern group involves parallel line segments, the parallel line segments are changed so as to have a single cutting direction.

Figure 11C:
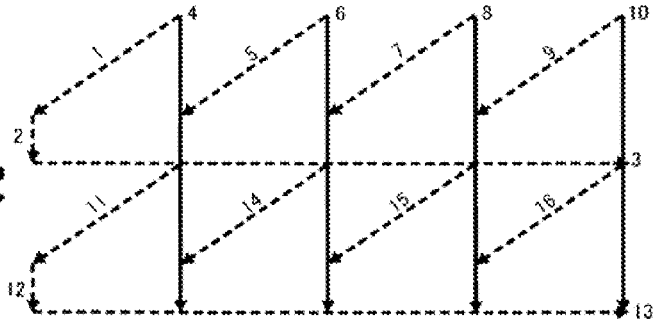
FIG. 11C shows parallel line segments with a uniformed cutting direction, out of the line segments of the cutting line as shown in FIG. 11B.
Figure 11D:
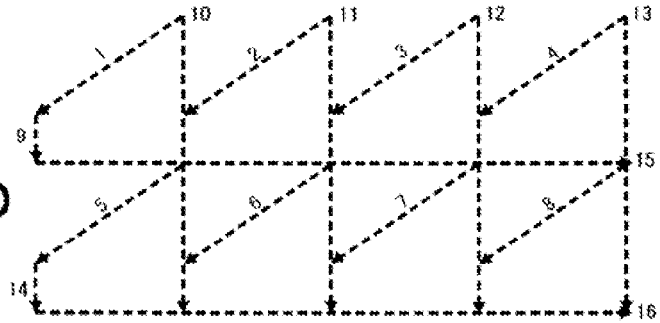
FIG. 11D shows cutting data on which every group of parallel line segments out of the line segments of the cutting line of FIG. 11C is cut.

In FIG. 11C, the line segments can be divided into a first group of line segments of cutting Nos. 1, 5, 7, 9, 11, 14, 15 and 16, a second group of line segments of cutting Nos. 2, 4, 6, 8, 10 and 12, and a third group of line segments of cutting Nos. 3 and 13, depending upon the cutting direction. The controller 61 then generates cutting data for sequentially cutting the line segments for every group (step S4). More specifically, a process of rearranging data whose cutting order is to be changed is executed regarding data of oblique line segments to be cut in the order of cutting Nos. 1, 5, 7, 9, 11, 14, 15 and 16 in FIG. 11C. As a result, the data of line segments of cutting Nos. 1, 5, 7, 9, 11, 14, 15 and 16 are changed to data for cutting in the order of cutting Nos. 1, 2, 3, 4, 5, 6, 7 and 8 as shown in FIG. 11D. In the same manner, data of line segments in the Y-direction indicated by cutting Nos. 2, 4, 6, 8, 10 and 12 as shown in FIG. 11C are changed by the data rearranging process into data for cutting of line segments in the order of cutting Nos. 9, 10, 11, 12, 13 and 14 as shown in FIG. 11D. Furthermore, data of line segments in the X direction indicated by cutting Nos. 3 and 13 in FIG. 11C are changed by the data rearranging process into data for the cutting of line segments in the order of cutting Nos. 15 and 16 as shown in FIG. 11D. The full data is thus generated as cutting data on which parallel line segments as shown in FIG. 11D are sequentially cut for every group. Accordingly, the direction of the blade 4*a* of the cutter 4 need not be changed during the cutting of line segments in each group when the patterns A to H are cut on the basis of the cutting data. This can realize the cutting of patterns A to H in a short period of time.

More specifically, the blade edge 4*c* of the cutter 4 is offset by distance d from the central axis 4*z* of the cutter axis 4*b* as described above (see FIG. 7). Accordingly, the blade edge 4*c* is subjected to resistance from the object 6 with relative movement of the cutter 4 and the object 6, whereby the cutter 4 is rotatively moved about the central axis 4*z*. The rotative movement automatically changes the direction of the blade edge 4*c* along the direction of relative movement. Accordingly, for example, when one line segment (a cutting line segment) and the other one (a cutting line segment) form an L-shape, the blade edge 4*c* of the cutter 4 faces the one line segment. Subsequently, the blade edge 4*c* is turned to the other segment line when the cutting of the other line segment starts (at the apex of L-shape). In this case, the central axis 4*z* is located distance d away from the apex of the L-shape. Therefore, in order that the blade edge 4*c* may be turned to the direction along the other line segment, the cutter 4 needs to be moved so that the central axis 4*z* draws an arc as viewed on a planar view. On the contrary, since the parallel line segments are sequentially cut in the example as described above, the cutter 4 need not be operated to be turned, whereupon the cutting time can be shortened.

The controller 61 determines at step S5 whether or not high-speed cutting has been set by user's input operation. When determining that high-speed cutting has been set (YES), the controller 61 generates full data which can further shorten the cutting time as compared with the new full data generated at steps S1 to S4. In this case, the controller 61 extracts line segments composing an outline of the pattern group as shown in FIG. 11D, based on the above-described line segment data of the pattern group. More specifically, the controller 61 extracts the line segments of cutting Nos. 1, 5, 9, 13, 14 and 16 and parts of the line segments of cutting Nos. 10 to 12 and 15. Extracted line segments form a stretch of outline as shown by solid line (cutting No. 1) in FIG. 11E. The controller 61 then generates cutting data with the apex $P_0$ serving as cutting start and end points $P_{13}$ based on coordinate data of apexes $P_0$ to $P_{12}$ composing data of the line segments (step S6). Generated cutting data has first coordinate data, second coordinate data, third coordinate data, and fourteenth coordinate data corresponding to cutting start point $P_0$, apex $P_1$, apex $P_2$, . . . and cutting end point $P_{13}$ respectively.

Figure 11E:
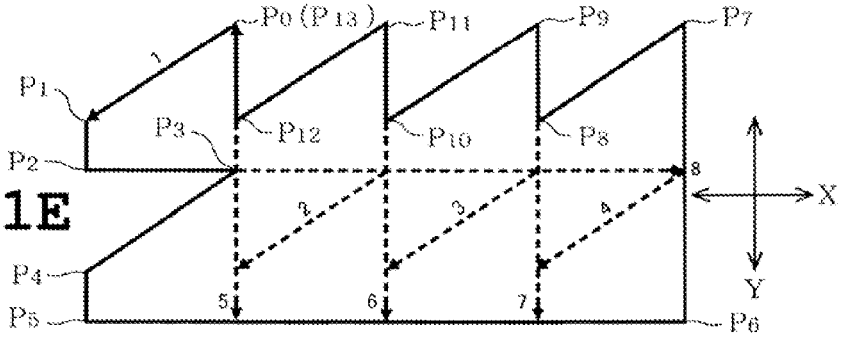
FIG. 11E shows a single continuous line segment obtained by changing the line segments constituting the outline out of the line segments of the cutting line as shown in FIG. 11D in order that the line segments constituting the outline may be cut collectively as the single continuous line.

The controller 61 further generates cutting data for line segments other than the outline of the pattern group, based on the line segment data of the pattern group (step S7). More specifically, the controller 61 extracts line segments (shown by broken line in FIG. 11E) obtained by removing the outline from all the line segments constituting the pattern group. The controller 61 carries out a process of rearranging the line segment data in a new order, based on coordinate data of the start and end points composing the line segment data. Cutting data for cutting line segments in the order of cutting Nos. 2 to 8 in FIG. 11E is generated by the rearranging process. New cutting data of cutting Nos. 1 to 8 (full data) is thus generated as shown in FIG. 12. The full data includes coordinate data of outline of cutting No. 1, line segments of cutting Nos. 2 to 4 in the inclined direction, line segments of cutting Nos. 5 to 7 in the Y direction, line segment of cutting No. 8 in the X direction and delimiter data affixed to respective ends of cutting data. Mask information as shown on top of FIG. 12 is represented as a minimum rectangular frame (not shown) surrounding the outline of cutting No. 1. The reason for this is that patterns A to H are regarded as a single pattern group as described above.

The controller 61 then writes generated new full data into the RAM 63 thereby to update the full data, ending the process. On the other hand, when determining that the high-speed cutting process is not set at step S5 (NO), the controller 61 writes the full data generated at steps S1 to S4 into the RAM 63 thereby to update the full data, ending the process.

Subsequently, when the high-speed cutting process is to be executed, the object 6 on the holding sheet 10 is cut on the basis of the generated the new full data (see FIG. 12). As a result, the cutter 4 is moved relative to the object 6 so that the outline of the pattern group constituted by the patterns A to H shown by solid line in FIG. 11E is cut collectively in continuity. Consequently, the outline of pattern group is effectively cut in continuity without the cutter 4 being spaced from the object 6.

The line segments of cutting Nos. 5 to 7 in FIG. 11E partially overlap between neighboring patterns in the high-speed cutting process. Accordingly, a cutting time is reduced by half regarding each overlapping part. Furthermore, the cutter 4 can efficiently cut the line segments of cutting Nos. 2 to 4 and the line segments of cutting Nos. 5 to 7 as shown by broken line in FIG. 11E without the direction of the blade being changed.

Furthermore, the whole length of the cutting line in the case of cutting a plurality of patterns A to H is reduced since the cutting is carried out on the basis of new full data regardless of set or unset high-speed cutting process. This is obvious from the comparison of FIG. 9A with FIG. 11D or 11E. In other words, this can reduce the relative movement of the cutter 4 during the cutting or the number of times of back feed of the holding sheet 10. Consequently, the occurrence of displacement of cutting position due to back feed of the holding sheet 10 can be reduced as much as possible while the cutting time is reduced.

The object 6 is pressed by the contact surface 56*f* as the result of drive of the solenoid 57 during the cutting. Accordingly, the object 6 can be held so as not to be displaced, by the pressing of the contact surface 56*f* as well as by the adhesive force of the adhesive layer 10*a* of the holding sheet 10. Additionally, the pressing member 56 is moved relative to the object 6 in the cutting. Since the contact surface of the pressing member 56 is made of a low-friction material, a frictional force generated between the contact surface 56*f* and the object 6 can be reduced as much as possible. Consequently, the displacement of the object 6 due to the frictional force can also be prevented, whereupon the object 6 can be held more reliably and a more accurate cutting line can be formed.

As understood from the foregoing, the controller 61 in the example executes a disposing routine (step S1) of disposing a plurality of patterns A to H so that at least a part of cutting lines of the patterns A to H including a plurality of continuous line segments A1 to A4, and H1 to H4 are neighboring in contact with each other. The controller 61 further executes an extracting routine (step S2) of extracting the contact portions of the cutting lines of the patterns A to H (step S2), a connecting routine (step S2) of connecting the cutting lines so that the cutting lines of the patterns A to H are joined with one another at the contact portions or so that the cutting lines of the patterns A to H and the contact portions are commonalized, and a cutting data generating routine of generating cutting data on the basis of the cutting lines of the patterns A to H connected in the connecting routine (see steps S3 and S4).

According to this configuration, the controller 61 can generate, as a cutting data generating unit, the cutting data in which the cutting lines are connected so that the cutting lines of the patterns A to H are joined with one another or commonalized. Accordingly, based on the generated cutting data, the patterns A to H can continuously be cut by using the contact portions or the commonalized cutting lines can be cut at once. Consequently, useless relative movement of the cutter 4 can be eliminated, whereby the cutting time can be reduced.

The controller 61 serves as an arranging unit which arranges the patterns A to H so that the line segments constituting the neighboring patterns overlap. According to this control manner, the cutting data of patterns A to H can be generated in which line segments of neighboring patterns overlap. Consequently, the cutting lines of neighboring patterns can collectively be cut along the line segments. Accordingly, the entire length of the cutting line necessary for the cutting of the patterns A to H is reduced, with the result of reduction in the cutting time.

The controller 61 connects the cutting lines of the neighboring patterns together as a cutting line to be cut consecutively. According to this configuration, the cutting data is generated on which the neighboring patterns are consecutively cut. Consequently, the neighboring patterns can consecutively cut on the basis of the cutting data.

When the neighboring patterns have linearly consecutive line segments of the cutting lines, the controller 61 connects these line segments together into a cutting line to be cut as a single line segment. According to this, the cutting data can be generated on which a plurality of line segments is effectively cut as a single line segment over a plurality of patterns. Furthermore, the line segments of cutting Nos. 13 and 16 in FIG. 11D and a part of the line segments constituting the outline in FIG. 11E are cut so that regions in which the patterns A to H are formed in the object 6 are divided by linear line segments. Consequently, the yield of the object 6 can be improved.

The cutter 4 is configured to be subjected to the resistance force of the object 6 and to change the direction of the blade 4*a* thereof by the movement relative to the object 6. Furthermore, the cutting data generating unit generates the cutting data on which when the line segments that are common to a plurality of patterns A to extend in the same direction, the line segments of these cutting lines are sequentially cut without change in the direction of the blade 4*a*. According to this, even when the cutter 4 is configured to be capable of changing the direction of the blade 4*a*, the cutting lines extending in the same direction can sequentially be cut without requirement of an operation to change the direction of the blade 4*a*. Accordingly, the time for changing the direction of the blade 4*c* can be eliminated.

The controller 61 regards the patterns A to H, as a single pattern group and generates the cutting data on which the cutting line of the outline of the whole pattern group is continuously cut. This can generate the cutting data on which the outline of the pattern group unifying the patterns A to H, that is, a stretch of cutting line is formed (see steps S6 and S7 and FIG. 11E). Consequently, the time required for the cutting of the patterns A to H can be reduced to a large extent.

Second Example

Figure 14B:
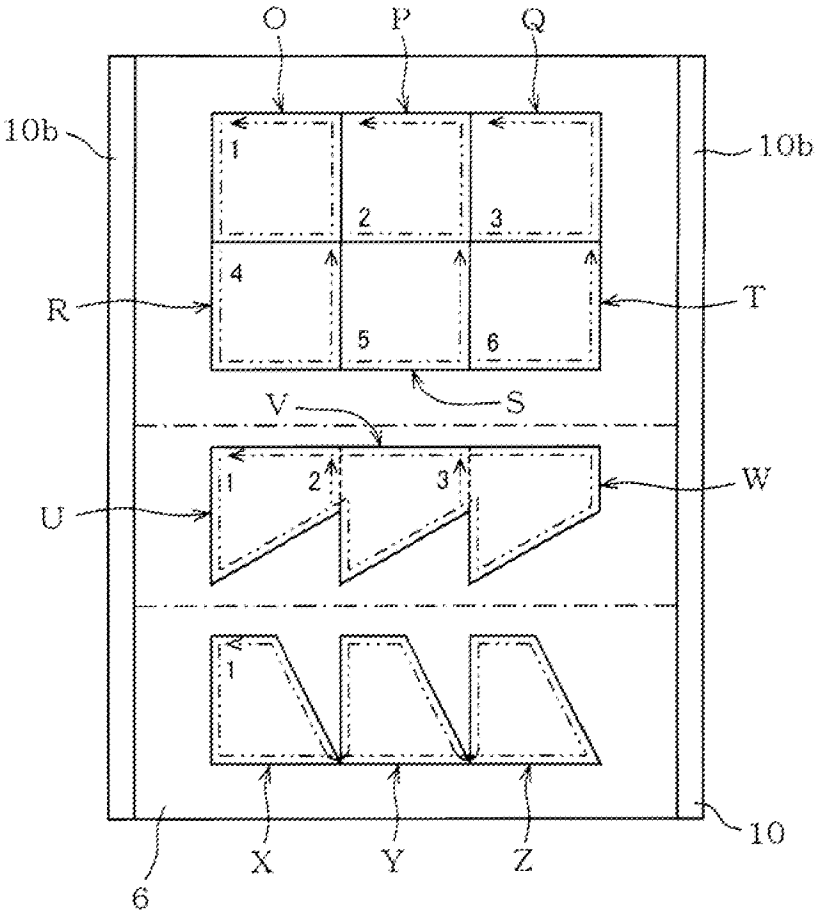
FIGS. 14A and 14B show a second example and a view of various patterns formed based on existing full data and a view of a plurality of patterns formed as the pattern group based on new full data respectively.
Figure 14A:
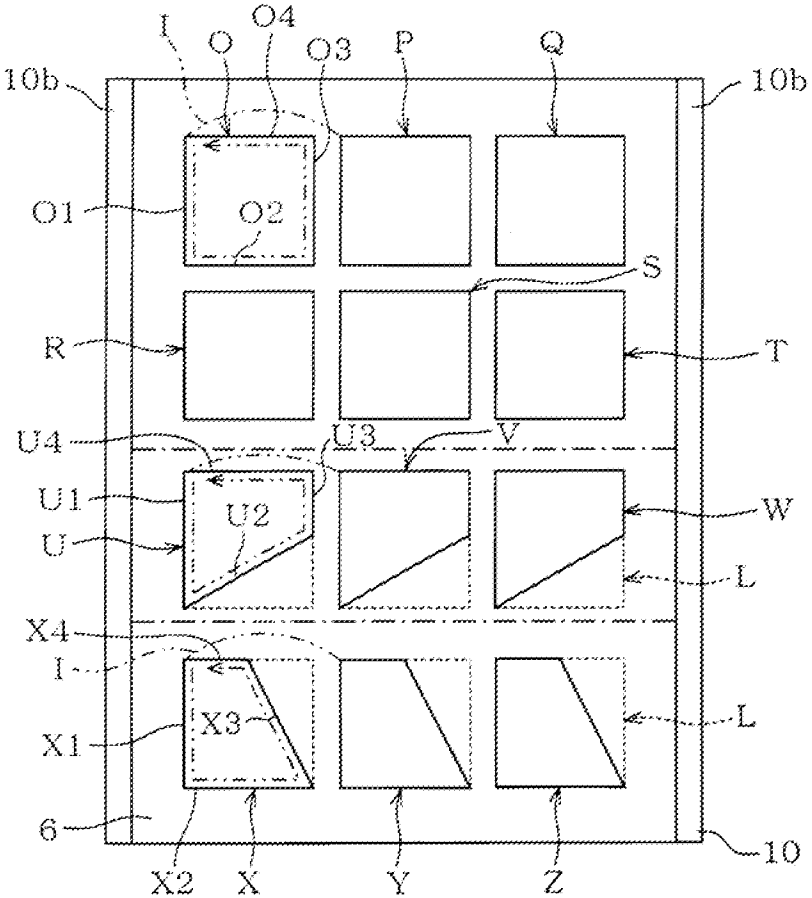

FIGS. 14A and 14B illustrate a second example. Differences of the second example from the first one will be described in the following. Identical or similar parts in the second example will be labeled by the same reference symbols as those in the first example.

In the cutting apparatus 1, new cutting data (see FIG. 12) is generated on the basis of the existing cutting data (the full data as shown in FIG. 10) provided for cutting a plurality of patterns A to H, as described above. The new cutting data can be stored in a storage unit such as the RAM 63 or the like, as data capable of significantly reducing the cutting time. Furthermore, in the cutting apparatus 1, new cutting data can be generated when the cutting data processing program is executed for existing cutting data on which various shapes and the numbers of patterns are cut as well as the patterns A to H.

More specifically, patterns O to Z exemplified in FIG. 14A are cut on the basis of existing cutting data. FIG. 14A shows six square patterns O to T on the top column, three trapezoidal patterns U to W on the middle column and three trapezoidal patterns X to Z on the lowest column. A cutting line of pattern O includes four line segments O1 to O4 and is a closed square having cutting start and end points corresponding to each other. An arrow of two-dot chain line inside the cutting line shows a cutting direction and order of line segments O1 to O4 of the pattern O. Cutting data (not shown) of the pattern O is composed of data of first to fifth coordinates corresponding to respective apexes. Each one of the other patterns P to T is a square comprising four line segments in the same manner as the pattern O. Coordinate values (first to fifth coordinate data) of the patterns P to T are set so that the respective patterns O to T are spaced from one another. "Mask information" in cutting data of the patterns O to T indicates that rectangular frames are squares corresponding to the patterns O to T, respectively (not shown).

In the cutting apparatus 1, new cutting data is generated on the basis of the existing full data provided for cutting the patterns O to T. In this case, the controller 61 executes the following processing instead of the above-described steps S2 to S4. More specifically, the controller 61 generates cutting data of cutting lines along which the patterns O to T are cut for every pattern in the order of the patterns O to T. Regarding overlapping line segments, the line segment to be firstly cut is excluded from the cutting lines. A pattern group as shown on the top column in FIG. 14B is formed based on the new cutting data. In this case, line segments to be cut include four line segments O1 to O4 of pattern O, three line segments (C-shaped line segments of cutting Nos. 2 to 4) of patterns P to R and two line segments of patterns S and T (inverted L-shaped line segments of cutting Nos. 5 and 6). These line segments are cut for every pattern.

The cutting line of pattern U as shown on the middle column in FIG. 14A includes four line segments U1 to U4. The cutting line has a pair of parallel opposite sides U1 and U3 at both sides thereof respectively. Arrows of two-dot chain line inside the cutting line show a cutting direction and order of line segments U1 to U4 of pattern U. Cutting data of pattern U has first to fifth coordinate data (not shown) corresponding to respective apexes. Each one of the other patterns V and W also has a trapezoidal shape comprising four line segments in the same manner as the pattern U. The patterns V and W have coordinate values which are set so that the patterns U to W are spaced from one another.

New cutting data is generated on the basis of the existing full data for the cutting of patterns U to W by the execution of a cutting data processing program.

More specifically, steps S1 to S7 are executed so that cutting data is generated regarding the cutting line of the pattern group shown on the middle column in FIG. 14B. Based on the new cutting data, a pattern group is formed which is arranged so that parallel line segments (opposite sides) in patterns U to W overlap. In this case, an outline (see cutting No. 1 in FIG. 14B) unifying the patterns U to W is cut and the remaining overlapping line segments (see cutting Nos. 2 and 3) are also cut.

The cutting line of pattern X as shown on the lowest column of FIG. 14A comprises four line segments X1 to X4. The cutting line has parallel upper and lower bases X4 and X2. An arrow of two-dot chain line inside the cutting line shows a cutting direction and order of line segments X1 to X4 of the pattern X.

Cutting data of the pattern X has first to fifth coordinate data (not shown) corresponding to respective apexes. Each of the other patterns Y and Z is a trapezoid comprising four line segments in the same manner as the pattern X. Coordinate values of the patterns Y and Z are set so that the respective patterns Y to Z are spaced from each other.

New cutting data is generated on the basis of the existing full data for the cutting of patterns X to Z by the execution of a cutting data processing program. More specifically, steps S1 to S7 arc executed so that cutting data is generated regarding the cutting line of the pattern group shown on the lowest column in FIG. 14B. Based on the new cutting data, a pattern group is formed which is arranged so that the patterns X to Z are brought into point contact with one another at lower apexes. In this case, all the patterns X to Z can be cut when the cutting is executed only along an outline (see cutting No. 1 in FIG. 14B) unifying the patterns X to Z.

As described above, when the patterns are square in shape as the patterns O to T as shown on the top column in FIG. 14B, the cutting data can be generated on which all the line segments other than the outline of the pattern group are arranged so as to overlap. Accordingly, differing from the first example, the second example can reduce the cutting line by half regarding the patterns S and T even when the patterns are cut for every pattern. Furthermore, the entire length of the cutting line necessary for the cutting of the patterns O to T can be reduced, whereby an efficient cutting can be executed.

As shown on the middle column in FIG. 14B, cutting data can be generated on which the patterns U to W are arranged in a predetermined direction (the X direction, for example) and the line segments other than the outline of the pattern group overlap. Consequently, the patterns U to W can be cut out by setting the high-speed cutting process and by cutting the outline (see cutting No. 1 in FIG. 14B) formed by unifying the patterns U to W and the remaining overlapping line segments (see cutting Nos. 2 and 3).

As shown on the lowest column in FIG. 14B, the cutting data can be generated on which the neighboring patterns X to Z are arranged so that all the cutting lines are consecutively (in a unicursal manner) connected together. Accordingly, delimiter data between the patterns X to Z can be eliminated. Consequently, the blade edge 4*c* of the cutter 4 need not be spaced from the object 6 so as to be moved to the position corresponding to the cutting start point of the next pattern relative to the object 6, with the result that the cutting time can be reduced as much as possible.

Third Example

Figure 15B:
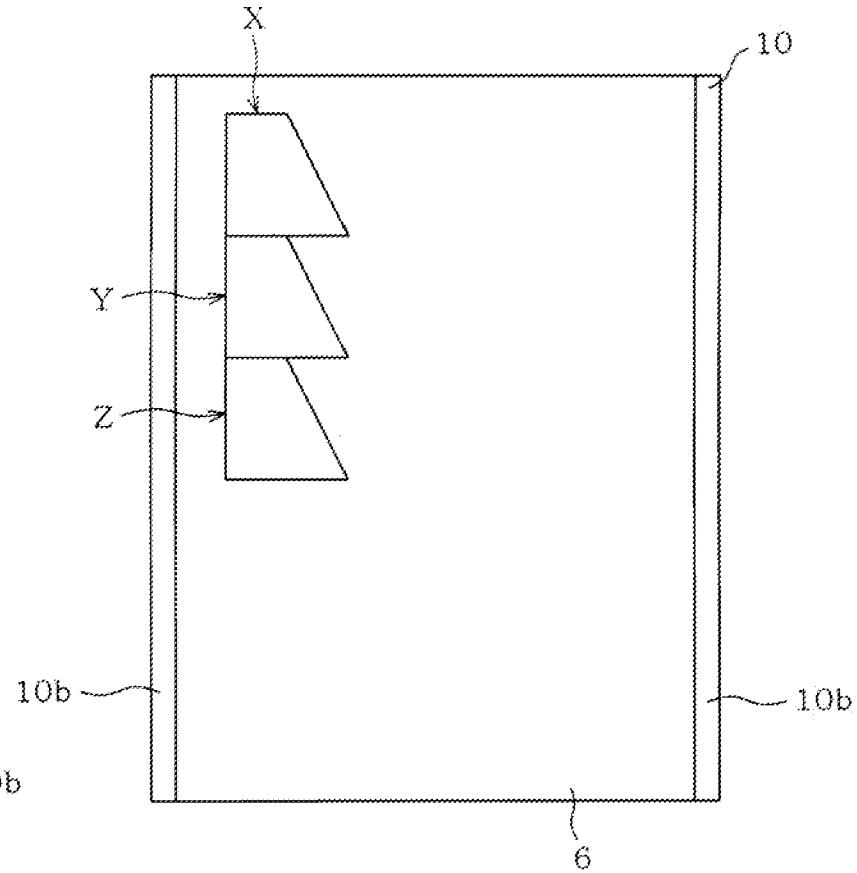
FIGS. 15A and 15B show a third example and explain new full data of a plurality of patterns generated using cutting data of a single existing pattern.
Figure 15A:
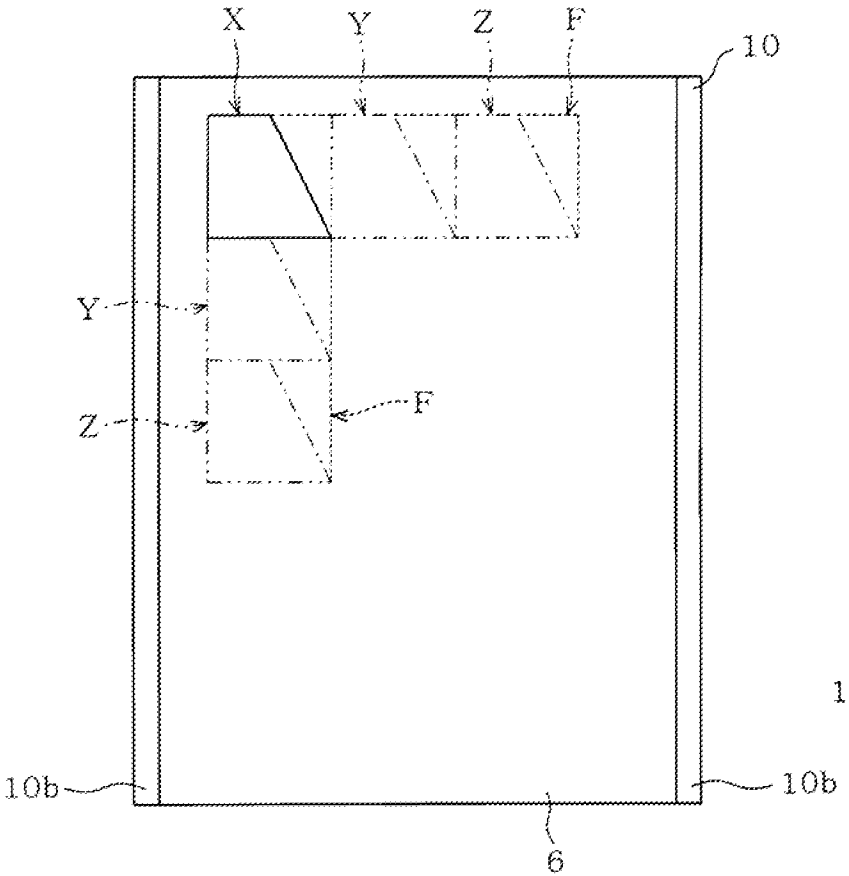

FIGS. 15A and 15B illustrate a third example. Differences of the third example from the second one will be described in the following. Identical or similar parts in the third example will be labeled by the same reference symbols as those in the second example.

The cutting apparatus 1 of the second example is configured to change the disposition of the patterns X to Z which are originally cut independently based on the existing full data. On the other hand, in the cutting apparatus 1 of the third example, a plurality of patterns X to Z is arranged using the cutting data of a single existing pattern X. More specifically, new cutting data is generated based on single cutting data of pattern X as shown in FIG. 15A. In the new cutting data, the same patterns X to Z are arranged in a predetermined direction (the X or Y direction). In this case, the line segments of the rectangular frame L of the pattern X are connected to new line segments of the rectangular frames L of the patterns Y and Z linearly in the X direction.

Accordingly, when arranged in the Y direction as shown in FIG. 15B, the patterns X to Z can be cut out only by cutting the outline of cutting No. 1 and the line segments of cutting Nos. 2 and 3 in the same manner as the patterns U to W in FIG. 14B. On the other hand, when the patterns X to Z are arranged in the X direction, the cutting data can be generated on which the cutting lines are connected together between the neighboring patters in the unicursal manner.

The cutting data of three or more patterns may be generated from a single existing pattern X. The cutting apparatus 1 may be configured so that the direction in which the patterns are arranged can be designated via one or more of the operation switches 65 or the like by the user.

Fourth Example

Figure 16:
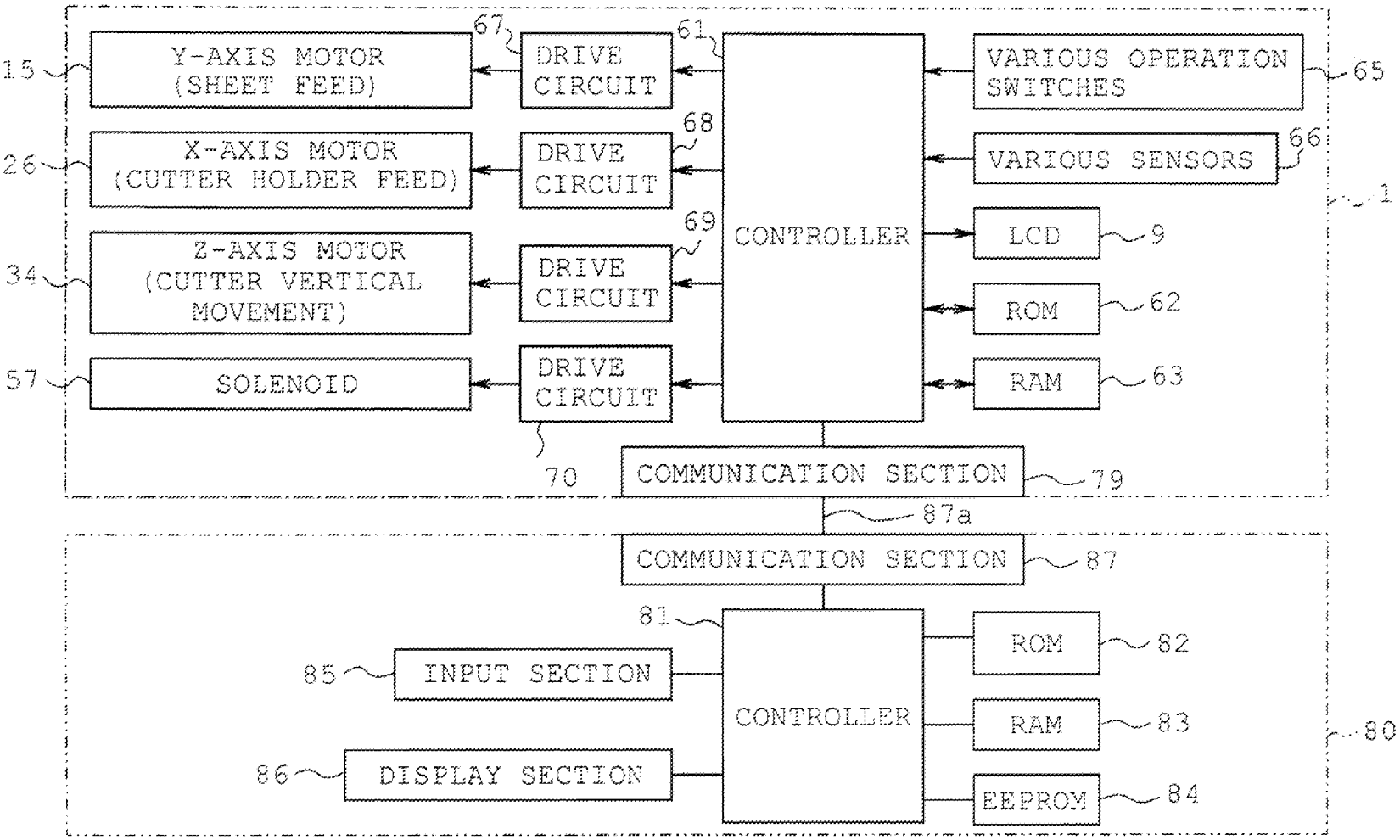
FIG. 16 is a view similar to FIG. 8, showing a fourth example.

FIG. 16 illustrates a fourth example. Differences of the fourth example from the first one will be described in the following. Identical or similar parts in the fourth example will be labeled by the same reference symbols as those in the first example.

FIG. 16 shows a personal computer (hereinafter, "PC 80") which is configured as a cutting data processing device processing the above-described cutting data. More specifically, PC 80 includes a controller 81 mainly constituted by a computer (CPU). A ROM 82, a RAM 83 and an EEPROM 84 are connected to the control circuit 81. An input section 85 and a display section 86 are also connected to the PC 80. The input section 85 includes a key board, a mouse and the like which are operated by the user for various instructions, selection and input operation. The display section 86 includes a liquid crystal display (LCD) which displays messages or the like necessary for the user.

The PC 80 includes a communication section 87 provided for wired connection to the cutting apparatus 1. On the other hand, the cutting apparatus 1 includes a communication section 79. Both communication sections 79 and 8 are connected together via a cable 87*a*, whereby data including the aforesaid cutting data and region data can be transmitted and received between the PC 80 and the cutting apparatus 1. Alternatively, the PC 80 and the cutting apparatus 1 may be wireless-connected. The controller 81 serving as a control unit controls the entire PC 80 and executes the cutting data processing program and the like. The ROM 82 stores the cutting data processing program and the like. The RAM 83 temporarily stores data and programs necessary for various processings. The RAM 83 has a storage region provided for storing cutting data and the like in the same manner as in the first example. The EEPROM 84 stores various cutting data (including full data).

The controller 81 reads the cutting data from the EEPROM 84 to execute the processing of the cutting data processing program, that is, the processing of the flowchart of FIG. 13. The controller 81 generates new cutting data which is capable of significant reduction of a cutting time, based on the existing cutting data for cutting a plurality of patterns. The generated cutting data is overwritten on the EEPROM 84. The cutting apparatus 1 cuts the object 6 based on the generated cutting data transmitted from the PC 80.

As described above, the controller 81 serves as an arranging unit, an extraction unit, a connecting unit and a cutting data generating unit in the same manner as in the first example. Accordingly, the controller 81 can generate new cutting data connected so that the cutting lines of the patterns are joined with one another or commonalized, based on the existing cutting data. Thus, the fourth example can achieve the same advantageous effects as those of the first to third examples.

The above-described examples should not be restrictive but may be modified or expanded as follows. The cutting apparatus 1 should not be limited by the above-described cutting plotter. The cutting apparatus 1 may be various types of devices or apparatuses provided with respective cutting functions.

The cutting data processing program stored in the cutting apparatus 1 or the storage unit of the PC 80 may be stored in a computer readable storage medium including a USB memory, a CD-ROM, a flexible disc, a DVD and a flash memory. In this case, when the cutting data processing program is read from the storage medium by computers of various data processing devices, the same operation and advantageous effects as those achieved by the foregoing examples can be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting apparatus comprising:

a cutter;

a controller;

a memory configured to store computer readable instructions therein, wherein the computer readable instructions instruct the controller to execute steps comprising:

arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other;

identifying the overlapping line segments of the peripheral lines of the patterns;

generating data representing a line including the identified overlapping line segments;

designating the plurality of patterns including the overlapping line segments as a pattern group and extracting parallel line segments from the line segments forming the pattern group;

grouping the extracted parallel line segments into line segments which are parallel to each other and denote an identical cutting direction;

determining a cutting order of the line segments composing the pattern group including the overlapping line segments, the cutting order being usable to sequentially cut the line segments for every pattern group; and generating a signal based on the generated data and the determined cutting order, wherein the cutter is configured to cut an object based on the signal.

2. The cutting apparatus according to the claim 1, wherein generating the data representing the line comprises generating the data representing the line which connects a first line of one of adjacent patterns among the plurality of the patterns and a second line of other of the adjacent patterns, and wherein generating the signal comprises generating the signal based on the generated data, wherein the cutter is configured to cut an object based on the signal.

3. The cutting apparatus according to the claim 1, wherein the peripheral line includes a plurality of sequential line segments, and wherein generating the data representing the line comprises generating the data representing the line which is connected a first line of one of adjacent patterns among the plurality of the patterns and a second line of other of the adjacent patterns, in a case where the a first line segment of the first line and a second line segment of the second line are along a certain direction.

4. The cutting apparatus according to the claim 1, wherein the peripheral line includes a plurality of sequential line segments, wherein the cutter has an edge of the cutter is configured to be movable, wherein generating the data representing the line comprises generating the data representing the line which connects the determined peripheral lines in the overlap portion along a same direction, wherein generating the signal comprises generating the signal based on the generated data, and wherein the edge of the cutter is configured to restrict to be movable based on the signal.

5. The cutting apparatus according to claim 1, wherein generating the data representing the line comprises generating the data representing a peripheral edge of a group of the plurality of the patterns, wherein generating the signal comprises generating the signal based on the generated data, wherein the cutter is configured to cut an object based on the signal.

6. The cutting apparatus according to claim 1, wherein the steps further comprise:

changing a cutting direction of one of the parallel line segments so that the cutting direction of the one parallel line segment corresponds with a cutting direction of the other parallel line segment, the cutting direction of the other parallel line segment being opposed to the cutting direction of the one parallel line segment; and grouping the parallel line segments as denoting the identical cutting direction.

7. An apparatus comprising:

a controller; and a memory configured to store computer readable instructions therein, wherein the computer readable instructions instruct the controller to execute steps comprising:

arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other;

identifying the overlapping line segments of the peripheral lines of the patterns;

generating data representing a line including the identified overlapping line segments;

designating the plurality of patterns including the overlapping line segments as a pattern group and extracting parallel line segments from the line segments forming the pattern group;

grouping the extracted parallel line segments into line segments which are parallel to each other and denote an identical cutting direction;

determining a cutting order of the line segments composing the pattern group including the overlapping line segments, the cutting order being usable to sequentially cut the line segments for every pattern group; and generating a signal based on the generated data and the determined cutting order, wherein a cutter is configured to cut an object based on the signal.

8. The apparatus according to the claim 7, wherein generating the data representing the line comprises generating the data representing the line which connects a first line of one of adjacent patterns among the plurality of the patterns and a second line of other of the adjacent patterns.

9. The apparatus according to the claim 7, wherein the peripheral line includes a plurality of sequential line segments, and wherein generating the data representing the line comprises generating the data representing the line which connects a first line of one of adjacent patterns among the plurality of the patterns and a second line of other of the adjacent patterns, in a case where a first line segment of the first line and a second line segment of the second line are along a certain direction.

10. The apparatus according to the claim 7, wherein the peripheral line includes a plurality of sequential line segments, wherein generating the data representing the line comprises generating the data representing the line which connects the determined peripheral lines in the overlap portion along a same direction, and wherein an edge of the cutter is configured to restrict to be movable based on the generated data.

11. The apparatus according to the claim 7, wherein generating the data representing the line comprises generating the data representing a peripheral edge of a group of the plurality of the patterns.

12. The apparatus according to claim 7, wherein the steps further comprise:

changing a cutting direction of one of the parallel line segments so that the cutting direction of the one parallel line segment corresponds with a cutting direction of the other parallel line segment, the cutting direction of the other parallel line segment being opposed to the cutting direction of the one parallel line segment; and grouping the parallel line segments as denoting the identical cutting direction.

13. A non-transitory computer readable storage medium storing computer readable instructions that, when executed, instruct an apparatus to execute steps comprising:

arranging a plurality of patterns, wherein the patterns include peripheral lines respectively, wherein the peripheral lines include a plurality of sequential line segments respectively and wherein arranging the plurality of patterns comprises arranging the patterns so that the line segments of adjacent patterns overlap each other;

identifying the overlapping line segments of the peripheral lines of the patterns;

generating data representing a line including the identified overlapping line segments;

designating the plurality of patterns including the overlapping line segments as a pattern group and extracting parallel line segments from the line segments forming the pattern group;

grouping the extracted parallel line segments into line segments which are parallel to each other and denote an identical cutting direction;

determining a cutting order of the line segments composing the pattern group including the overlapping line segments, the cutting order being usable to sequentially cut the line segments for every pattern group; and generating a signal based on the generated data and the determined cutting order, wherein a cutter is configured to cut an object based on the signal.

14. The non-transitory computer readable storage media according to the claim 13, wherein generating the data representing the line comprises generating the data representing the line which connects a first line of one of adjacent patterns among the plurality of the patterns and a second line of other of the adjacent patterns.

15. The non-transitory computer readable storage media according to the claim 13, wherein the peripheral line includes a plurality of sequential line segments, and wherein generating the data representing the line comprises generating the data representing the line which connects a first line of one of adjacent patterns among the plurality of the patterns and a second line of other of the adjacent patterns, in a case where the a first line segment of the first line and a second line segment of the second line are along a certain direction.

16. The non-transitory computer readable storage media according to the claim 13, wherein the peripheral line includes a plurality of sequential line segments, wherein generating the data representing the line comprises generating the data representing the line which connects the determined peripheral lines in the overlap portion along a same direction, and wherein the cuter has an edge of the cutter is configured to restrict to be movable based on the generated data.

17. The non-transitory computer readable storage media according to the claim 13, wherein generating the data representing the line comprises generating the data representing a peripheral edge of a group of the plurality of the patterns.

18. The non-transitory computer readable storage medium according to claim 13, wherein the steps further comprise:

changing a cutting direction of one of the parallel line segments so that the cutting direction of the one parallel line segment corresponds with a cutting direction of the other parallel line segment, the cutting direction of the other parallel line segment being opposed to the cutting direction of the one parallel line segment; and grouping the parallel line segments as denoting the identical cutting direction.

* * * * *